US007246870B2

(12) United States Patent
Takano

(10) Patent No.: US 7,246,870 B2
(45) Date of Patent: Jul. 24, 2007

(54) LIQUID DROPLET EJECTION METHOD, LIQUID DROPLET EJECTION DEVICE, NOZZLE ABNORMALITY DETERMINATION METHOD, DISPLAY DEVICE, AND ELECTRONIC APPARATUS

(75) Inventor: Yutaka Takano, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 221 days.

(21) Appl. No.: 10/978,536

(22) Filed: Nov. 2, 2004

(65) Prior Publication Data

US 2005/0116979 A1 Jun. 2, 2005

(30) Foreign Application Priority Data

Nov. 10, 2003 (JP) ..... 2003-379905
Nov. 10, 2003 (JP) ..... 2003-379906
Aug. 11, 2004 (JP) ..... 2004-234119

(51) Int. Cl.
*B41J 29/393* (2006.01)
*B41J 2/165* (2006.01)

(52) U.S. Cl. ..... 347/19; 347/23

(58) Field of Classification Search ..... 347/19, 347/23

See application file for complete search history.

(56) References Cited

U.S. PATENT DOCUMENTS

2002/0080375 A1* 6/2002 Waldner et al. ..... 347/23

FOREIGN PATENT DOCUMENTS

JP A-10-044399 2/1998
JP 10-268127 10/1998

* cited by examiner

*Primary Examiner*—Julian D. Huffman
(74) *Attorney, Agent, or Firm*—Oliff & Berridge PLC

(57) ABSTRACT

To provide a liquid droplet ejection method which can detect abnormality of a nozzle, an ejection head including a plurality of nozzles has, for the respective nozzles, a camera unit that images from the inside of a nozzle to its peripheral portion. A captured image processing unit converts the captured image into an image which can recognize at least one of a state of a meniscus inside the nozzle, the shape of a nozzle opening and states of surface films formed inside and outside the nozzle, and sends the converted image to a comparison determination unit. The comparison determination unit compares the converted image with a reference image which is previously stored in a determination condition storing unit. As a result, for an objective nozzle, the quality (nozzle abnormality) of ejection performance is determined.

18 Claims, 14 Drawing Sheets

FIG. 7
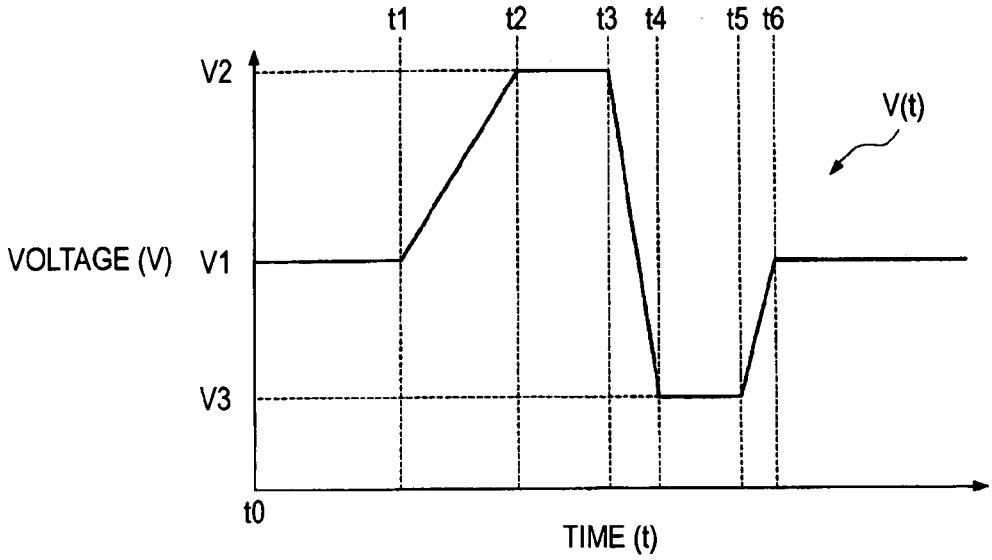
FIG. 8A t0-t1
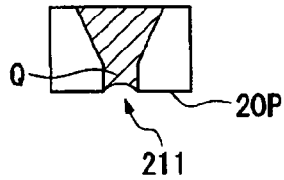
FIG. 8B t1-t2
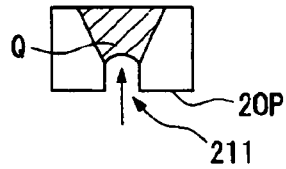
FIG. 8C t3-t4
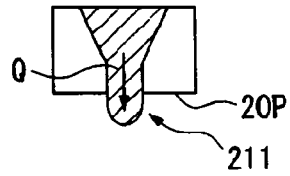
FIG. 8D t4-t6
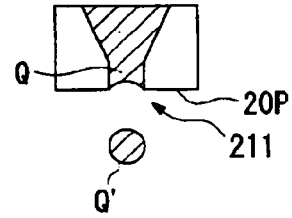

LIQUID DROPLET EJECTION METHOD, LIQUID DROPLET EJECTION DEVICE, NOZZLE ABNORMALITY DETERMINATION METHOD, DISPLAY DEVICE, AND ELECTRONIC APPARATUS

BACKGROUND OF THE INVENTION

1. Field of Invention

Exemplary aspects of the present invention relate to a liquid droplet ejection method, a liquid droplet ejection device, a nozzle abnormality determination method, a display device and an electronic apparatus.

2. Description of Related Art

Related art ink jet devices (liquid droplet ejection device) are widely used as ink jet printers. In such an ink jet device, an ejection head can be miniaturized and constructed with a high-density structure. Further, it is possible to land ink (liquid droplet, liquid material) at a target position with high precision. Then, such an ink jet device does not depend on a type or nature of ink to be ejected. Further, it can be applied to a printing medium, such as a film, a fabric, a glass substrate and a metallic substrate, other than paper. Moreover, it has a low noise during printing and is manufactured at low cost.

SUMMARY OF THE INVENTION

In such an ink jet device, if a residual of an ink or other contaminants are attached to a nozzle forming surface of an ejection head, ejection precision when a liquid droplet is ejected is lowered and a defective ejection is caused. Thus, a method is required in which, prior to the liquid droplet ejection, the nozzle forming surface is cleaned or an ink inside the nozzle is sucked up.

Further, a related art method, in which abnormality of an ink, a bubble-like residual of an ink or a stain of an ink attached to a nozzle unit is observed with a camera, and a suction removal of the ink is performed is disclosed. For example, see Japanese Unexamined Patent Application Publication No. 10-268127

SUMMARY OF THE INVENTION

Defective ejection in an ink jet device may also be caused by a large diameter of the nozzle, abnormality of a nozzle outline, a removal of a liquid repellent film in a peripheral portion and the inside of the nozzle, or clogging of a foreign substance, other than the above-mentioned causes. In particular, in a case in which a corrosive liquid material, such as an organic solvent, acid or alkali for industrial use, is ejected, the inside and the outside of the nozzle are exposed to the corrosive liquid material. Thus, the above-mentioned causes are easily generated.

In a case in which an industrial product is continuously manufactured using a liquid droplet ejection method with the defective ejection due to the above-mentioned causes, many defective products are produced, which results in increasing the cost of the product.

Exemplary aspects of the present invention address and/or solve the above and/or other problems. Exemplary aspects of the present invention provide a liquid droplet ejection method which can detect abnormality of a nozzle. In particular, exemplary aspects of the present invention provide a nozzle abnormality determination method, a liquid droplet ejection device and a liquid droplet ejection method, which can determine abnormality of the nozzle early and eject liquid droplets normally and precisely only by normal nozzles. Further, exemplary aspects of the present invention provide a liquid droplet ejection method and a liquid droplet ejection device which can eject the liquid droplets normally and precisely in a state in which a meniscus inside the nozzle is favorably formed. Exemplary aspects of the present invention provide display device manufactured using the liquid droplet ejection device, and an electronic apparatus including the display device.

A liquid droplet ejection method of an exemplary aspect of the present invention, in which a liquid material as a liquid droplet is ejected from an ejection head having a plurality of nozzles and is printed, includes imaging the inside of the nozzle to its peripheral portion, and, for the respective nozzles, acquiring an image which can recognize at least one of a state of a meniscus inside a nozzle, the shape of a nozzle opening and states of surface films formed inside and outside the nozzle. Further, incidentally to the liquid droplet ejection method, the quality of each of the nozzles may be determined base on image information.

Here, the printing is not limited to a printing using a so-called ink, and it may include a printing of which an object is to land a liquid material, in which fine particles are dispersed, as liquid droplets and to fix the liquid droplets onto a printing medium to form a pattern.

The state of the meniscus indicates, for example, a position of a liquid surface portion (meniscus) of the liquid material, which is filled inside the nozzle, from the nozzle opening, the shape of a contact portion of the meniscus and the inner surface of the nozzle, a contact angle of the meniscus and the inner surface of the nozzle, and presence and absence of a foreign substance in the vicinity of the meniscus.

The shape of the nozzle opening indicates the shape of an outline or a diameter of the nozzle opening (hole).

The states of the surface films formed inside and outside the nozzle indicate film thickness distribution of a water repellent film or a protective film formed inside the nozzle to its peripheral portion or a removal degree of the film.

The quality of the ejection performance indicates quality relating to a degree regarding stability and rectilinearity or reliability of the liquid droplets to be ejected. With regard to a nozzle (hereinafter, "defective nozzle") which has defective ejection, such as non-ejection, curved flight of liquid droplets, deterioration of land precision, variation of the amount of liquid droplets or generation of mist causes or is likely to cause, it is determined that the nozzle is abnormal.

In determining abnormality, a method in which an operator views a captured image and compares it with the shape of a normal nozzle to determine abnormality, or a method in which an image of a peripheral portion of an imaged nozzle is read in an arithmetic device, such as a computer, and an image processing is performed, such that a comparison with the shape of the normal nozzle is automatically performed may be used.

According to this construction, since it is possible to detect a defective nozzle based on the acquired image, it is possible to reduce the likelihood or prevent manufacture of an industrial product using a liquid droplet ejection method with defective ejection. Further, in such a manner, the defective nozzle is discovered early it is possible to recover an abnormal nozzle or to exchange an ejection head. Otherwise, various defective products that are formed using a liquid droplet ejection method are produced in large quantities. Therefore, it is possible to reduce detect costs and thus it is possible to reduce a manufacturing cost.

In order to achieve the above, exemplary aspects of the present invention adopt the following.

A method of determining nozzle abnormality of an exemplary aspect of the present invention which determines abnormality of a nozzle of an ejection head which includes an ejection unit to eject a liquid droplet, after imaging the peripheral portion of the nozzle, compares the shape of the nozzle with the shape of a normal nozzle and determines abnormality of the imaged nozzle.

If doing so, unlike a technique in which abnormality of a liquid material (ink), a bubble-like residual of the ink or a stain of the ink attached to a nozzle unit is observed, as in the related art, after imaging the peripheral portion of the nozzle, by comparing the captured image with the shape of the normal nozzle, abnormality of the nozzle is determined. Thus, it is possible to discover early an abnormal nozzle. Therefore, since there is no liquid droplet to be ejected in a state in which the nozzle is abnormal, it is possible to reduce the likelihood or prevent defective ejection of liquid droplets, a curved flight of liquid droplets, deterioration of land precision, variation of the amount of liquid droplets, or generation of mist due to the abnormal nozzle.

Further, when an operator views an image of the peripheral portion of the nozzle to determine abnormality, it is possible for the operator to determine abnormality of the nozzle based on the operator's knowledge or experience.

Further, when the image processing or the like is performed using the arithmetic device, it is possible to perform automatically the determination of nozzle abnormality.

Further, by recovering the abnormal nozzle or exchanging the ejection head having the abnormal nozzle, it is possible to make all the nozzles in the ejection head in a favorable state so that normal ejection is possible. Therefore, it becomes possible to eject the liquid droplets according to a drive signal which is supplied to the ejection unit. It is possible to attain high precision for landing positions of liquid droplets, variation reduction of the liquid droplet amount, prevention of curved flight or suppression of mist.

Further, by determining abnormality or normality of the nozzle, when it is determined that the nozzle is normal, the nozzle may be used as it is. When it is determined that the nozzle is abnormal, the nozzle may be recovered or the ejection head may be exchanged. Thus, as compared with simple regular recovery of the nozzle or exchange of the ejection head, it is not needed to perform a useless recovery operation to the normal nozzle and to exchange uselessly the ejection head having the normal nozzle. Specifically, it is possible to perform the recovery process or the exchange process.

Further, in a method of determining abnormality of a nozzle according to an exemplary aspect of the present invention, abnormality of the nozzle is determined as a first abnormality in which the nozzle can be recovered by a recovery operation or a second abnormality in which the nozzle cannot be recovered by the recovery operation.

If doing so, for example, when the determination result is the first abnormality, it is possible to recover the abnormal nozzle to allow the liquid droplets to be ejected again. Further, when the determination result is the second abnormality, the ejection head itself is exchanged. Thus it is possible to allow the liquid droplets to be ejected again.

Further, in the nozzle determined as the first abnormality, the nozzle is recovered by the recovery operation without exchanging the ejection head. Thus it is possible to simplify the exchange process of the ejection head and it is possible to save the liquid material within the ejection head, for example, as compared with promptly exchanging the ejection head when abnormality of the nozzle is determined. Further, for example, a high-priced industrial liquid material does not become useless. Thus, it is possible to reduce production cost.

Further, in a method of determining abnormality of a nozzle according to an exemplary aspect of the present invention, after the ejection head ejects the liquid droplets a predetermined number of times, the peripheral portion of the nozzle is imaged.

If doing so, since the liquid droplet is ejected a predetermined number of times, it is possible to image the state of the nozzle changed by corrosion. Further, based on the image imaged in such a manner, abnormality or normality of the nozzle is determined. Thus it is possible to discover the abnormal nozzle generated while the liquid droplet is ejected a predetermined number of times.

Further, in a method of determining abnormality of a nozzle according to an exemplary aspect of the present invention, the peripheral portion of the nozzle is imaged at a magnified scale or at a reduced scale.

If doing so, for example, it is possible to image the shape of the nozzle in detail at the time of the magnified scale. Further, it is possible to image a plurality of nozzles simultaneously at the time of the reduced scale.

In order to achieve the above, exemplary aspects of the present invention adopt the following.

A liquid droplet ejection method according to an exemplary aspect of the present invention, in which an ejection head provided with an ejection unit to eject the liquid droplet from a nozzle and a substrate arranged at a position opposing the ejection head move relatively, and the liquid droplet is ejected onto the substrate according to a voltage waveform of a drive signal to be supplied to the ejection unit, includes imaging a peripheral portion of the nozzle, comparing the shape of the nozzle with the shape of a normal nozzle, and determining the abnormality of the imaged nozzle.

If doing so, an abnormal nozzle is discovered early. Thus, it is possible to recover an abnormal nozzle or to exchange an ejection head, before various defective products to be formed using a liquid droplet ejection device are produced in large quantities. Thus, it is possible to reduce a defective costs. That is, since it is completed without defective products, it is possible to reduce manufacturing costs.

In order to achieve the above, exemplary aspects of the present invention adopt the following.

A liquid droplet ejection method according to an exemplary aspect of the present invention, includes an ejection head provided with an ejection unit to eject a liquid droplet from a nozzle and a substrate arranged at a position opposing the ejection head move relatively, and the liquid droplet is ejected onto the substrate according to a voltage waveform of a drive signal to be supplied to the ejection unit, and in which, in the ejection head, the inside of the nozzle is imaged. Further, based on an image acquired by imaging the inside of the nozzle, the quality of the nozzle may be determined.

If doing so, unlike a technique in which abnormality of a liquid material (ink), a bubble-like residual of the ink or a stain of the ink attached to a nozzle unit is observed as in the related art, the inside of the nozzle is imaged. Thus it is possible to image the state of the liquid material inside the nozzle. Based on the image imaged in such a manner, it becomes possible to determine the quality of the nozzle. Further, based on the determination result, the defective nozzle is enhanced, and it is possible to place all the nozzles in the ejection head in a favorable state so that each nozzle can normally eject.

Therefore, it is possible to eject the liquid droplets according to the drive signal supplied to the ejection portion and it is possible to attain high precision of position of the substrate on which the liquid droplet is ejected (high precision of the landing position) and variation reduction of the liquid droplet amount.

Further, based on the determination result of the normal nozzle and the defective nozzle, the defective nozzle may be enhanced, and the normal nozzle may be used as it is. Thus, as compared with simply sucking the liquid materials equally in the normal nozzle and the defective nozzle, there is no need to suck the liquid material in the normal nozzle uselessly. That is, since it is possible to save the liquid material, a high-priced industrial liquid material does not become useless, and thus it is possible to reduce the production cost.

Further, in the liquid droplet ejection method according to an exemplary aspect of the present invention, when the inside of the nozzle is imaged, a contact state of a liquid material filled inside the nozzle and an inner surface of the nozzle is imaged.

If doing so, instead of simply imaging the inside of the nozzle, the contact state of the liquid surface portion (meniscus) the liquid material filled inside the nozzle and the inner surface of the nozzle is imaged. Thus, it becomes possible to determine the quality of the meniscus required to normally eject the liquid droplets and it is possible to enhance a defective meniscus based on the determination result. As a result, it is possible to place the meniscus in all the nozzles in a favorable state so that a normal ejection is possible.

Therefore, by imaging the meniscus, it is possible to further promote the effects of the above-mentioned liquid droplet ejection method.

Further, in the liquid droplet ejection method according to an exemplary aspect of the present invention, after the ejection head ejects the liquid droplets a predetermined number of times, the inside of the nozzle is imaged.

If doing so, it is possible to image the state of the inside of the nozzle changed by ejecting the liquid droplets a predetermined number of times. Further, the quality of the nozzle is determined based on the image imaged in such a manner. Thus, it is possible to discover the defective nozzle generated when the liquid droplet is ejected a predetermined number of times.

Further, in the liquid droplet ejection method according to an exemplary aspect of the present invention, before the inside of the nozzle is imaged, a nozzle forming surface of the ejection head is wiped.

If doing so, it is possible to remove the residual of the liquid material attached to the nozzle forming surface by wiping. Thus it is possible to maintain the nozzle forming surface in a clean state.

Further, generally, if the liquid droplet is ejected in a state in which the residual of the liquid material is attached to the vicinity of the nozzle, a curved flight is caused, such that the landing precision is lowered. However, in an exemplary aspect of the present invention, the residual of the liquid material that results in causing the curved flight can be removed by wiping. Thus it is possible to improve the landing precision.

Further, in the liquid droplet ejection method according to an exemplary aspect of the present invention, regarding a determination result of the quality of the nozzle, if it is determined that the nozzle is defective, the liquid material is sucked up from a nozzle forming surface of the ejection head via the nozzle.

If doing so, by sucking the liquid material, the liquid material filled in the ejection head flows into the nozzle forming surface via the nozzle, and the liquid material in the defective nozzle forcibly flows. Thus, it is possible to fill the liquid material in the defective nozzle and simultaneously it is possible to form the meniscus in the defective nozzle.

Therefore, it is possible to enhance the defective nozzle so as to eject normally the liquid droplet.

Further, in the liquid droplet ejection method according to an exemplary aspect of the present invention, the ejection head includes a plurality of nozzles, and, regarding the determination results of qualities of the plurality of nozzles, if it is determined that at least one of the nozzles is defective, the liquid material is sucked up from the nozzle forming surface via only the defective nozzle.

If doing so, it is possible to suck the liquid material from only the defective nozzle among the plurality of nozzles, and to fill the defective nozzle. Here, from the nozzles, which are determined as normal, among the plurality of nozzles, the liquid material is not sucked. Thus, the liquid material is not sucked uselessly.

Therefore, for example, in the ejection head filled with high-priced liquid material, it is not needed to suck the liquid material uselessly. Thus it is possible to save the liquid material.

Further, in the liquid droplet ejection method according to an exemplary aspect of the present invention, the ejection head includes a plurality of nozzles and a plurality of nozzle regions in which the plurality of nozzles are divided into groups having a predetermined number of nozzles. Regarding the determination results of qualities of the plurality of nozzles, if it is determined that at least one of the nozzles is defective, the liquid material is sucked up from the nozzle forming surface via the nozzle region having the defective nozzle.

If doing so, it is possible to suck the liquid material from only the nozzle region having the defective nozzle and to fill the liquid material in the defective nozzle. Here, from the nozzle regions having the nozzles, which are determined as normal, among the plurality of nozzles, the liquid material is not sucked. Thus the liquid material is not sucked uselessly. Therefore, for example, in the ejection head filled with the high-priced liquid material, it is not needed to suck the liquid material uselessly. Thus it is possible to save the liquid material. Further, generally, in the case in which a nozzle pitch is minute, a minute suction unit to suck the liquid material from only one nozzle is needed. Thus the suction of the liquid material is difficult. However, in an exemplary aspect of the present invention, in the case in which the liquid material is sucked from the nozzle region, it is possible to enlarge the size of the suction unit. Thus it is possible to perform the suction of the liquid material. Further, as compared with sucking the liquid material from all the nozzles, the liquid material is sucked from only the nozzle region having the defective nozzle. Thus it is possible to save the liquid material.

Further, in the liquid droplet ejection method according to an exemplary aspect of the present invention, liquid droplets or contaminants remaining on a nozzle forming surface of the ejection head is imaged, and it is determined whether or not the remaining liquid droplets or contaminants are within a predetermined distance from the nozzle.

Here, at the time of imaging the liquid droplets or the contaminants on the nozzle forming surface, an imaging unit which images the inside of the nozzle may be viewed. Further, as a result of determining whether or not the residuary liquid droplets or contaminants are within the predetermined distance from the nozzle, if it is determined that the residuary liquid droplets or contaminants are within the predetermined distance from the nozzle, the liquid droplets or contaminants may be removed. Further, if the residuary liquid droplets or contaminants are not within the predetermined distance from the nozzle, the liquid droplets or contaminants may remain.

In order to achieve the above, exemplary aspects of the present invention adopt the following. A liquid droplet ejection device according to an exemplary aspect of the present invention, in which an ejection head provided with an ejection unit to eject a liquid droplet from a nozzle and a substrate arranged at a position opposing the ejection head move relatively, and the liquid droplet is ejected onto the substrate according to a voltage waveform of a drive signal to be supplied to the ejection unit, includes an imaging unit to image a peripheral portion of the nozzle in the ejection head, and a determination unit to compare the shape of the nozzle imaged by the imaging unit with the shape of a normal nozzle and determining abnormality of the imaged nozzle.

If doing so, the abnormal nozzle is discovered early. Thus it is possible to recover an abnormal nozzle or to exchange an ejection head, before various defective products to be formed using a liquid droplet ejection device are produced in large quantities. Thus, it is possible to reduce a defect costs. That is, since it is completed without defective products, it is possible to reduce manufacturing cost.

Further, in the liquid droplet ejection device according to an exemplary aspect of the present invention, the device may include a recovery unit to wipe a nozzle forming surface of the ejection head to recover the nozzle.

If doing so, the recovery unit wipes the nozzle forming surface in which the nozzle determined as the first abnormality is formed. Thus, the nozzle can be recovered to normal.

Therefore, by the recovery of the nozzle, it is possible to attain high precision of landing positions of the liquid droplets, variation reduction of the liquid droplet amount, prevention of the curved flight or suppression of mist.

In order to achieve the above, exemplary aspects of the present invention adopt the following.

A liquid droplet ejection device, in which an ejection head provided with an ejection unit to eject a liquid droplet from a nozzle and a substrate arranged at a position opposing the ejection head move relatively, and the liquid droplet is ejected onto the substrate according to a voltage waveform of a drive signal to be supplied to the ejection unit, includes an imaging unit to image the inside of the nozzle in the ejection head. Further, the device may include a determination unit to determine the quality of the nozzle based on the image of the inside of the nozzle imaged by the imaging unit.

If doing so, the abnormal nozzle is discovered early, and thus it is possible to recover an abnormal nozzle or to exchange an ejection head, before various defective products to be formed using a liquid droplet ejection device are produced in large quantities. Thus, it is possible to reduce defect costs. Since it is completed without defective products, it is possible to reduce manufacturing costs.

Further, in an exemplary aspect of the present invention, the image acquired by imaging the peripheral portion of the nozzle is may be a color image or a monochrome image.

If doing so, for example, at the time of the color image, it is possible to confirm the shape of the nozzle or the corrosion state of the peripheral portion, and the residual of the liquid material attached to the vicinity of the nozzle. Thus, it is possible to acquire imaging information in detail. Further, at the time of the monochrome image, it is possible to confirm the shape of the nozzle in an image of white and black mode. Thus it is possible to image imaging information more simply than the color image.

Further, a display device according to an exemplary aspect of the present invention is manufactured using the above-mentioned liquid droplet ejection devices.

If doing so, it is possible to form a pattern, such as wiring lines or pixels by landing precisely a predetermined liquid material onto a predetermined position. Thus, it is possible to design a manufacturing process more simply than a related art photolithography technique.

Since the display device is manufactured using the liquid droplet ejection device having the above-mentioned imaging unit, it is possible to attain high precision of the liquid droplet ejection (high precision of the landing position) and variation reduction of the liquid droplet amount. Further, it is possible to reduce the defect costs caused by the production of defective display devices.

Further, an electronic apparatus according to an exemplary aspect of the present invention includes the above-mentioned display device.

If doing so, it is possible to attain the same effects as those of the above-mentioned display device, and simultaneously it becomes possible to provide a suitable electronic apparatus.

As such an electronic apparatus, for example, as a cellular phone, a mobile information terminal, a clock, or an information processing device, such as a word processor and a personal computer may be exemplified.

BRIEF DESCRIPTION OF THE DRAWINGS

FIG. 7 is a schematic showing an example of a voltage waveform of a drive signal which is supplied to the ejection head;

FIG. 8A is a cross-sectional schematic showing parts of a nozzle, which shows a state of a meniscus for a period of t0 to t1 of the voltage waveform, FIG. 8B is a cross-sectional schematic showing the parts of the nozzle, which shows a state of the meniscus for a period of t1 to t2 of the voltage waveform; FIG. 8C is a cross-sectional schematic showing the parts of the nozzle, which shows a state of the meniscus for a period of t3 to t4 of the voltage waveform, and FIG. 8D is a cross-sectional schematic showing the parts of the nozzle, which shows a state of the meniscus for a period of t4 to t6 of the voltage waveform;

DETAILED DESCRIPTION OF EXEMPLARY EMBODIMENTS

Figure 1:
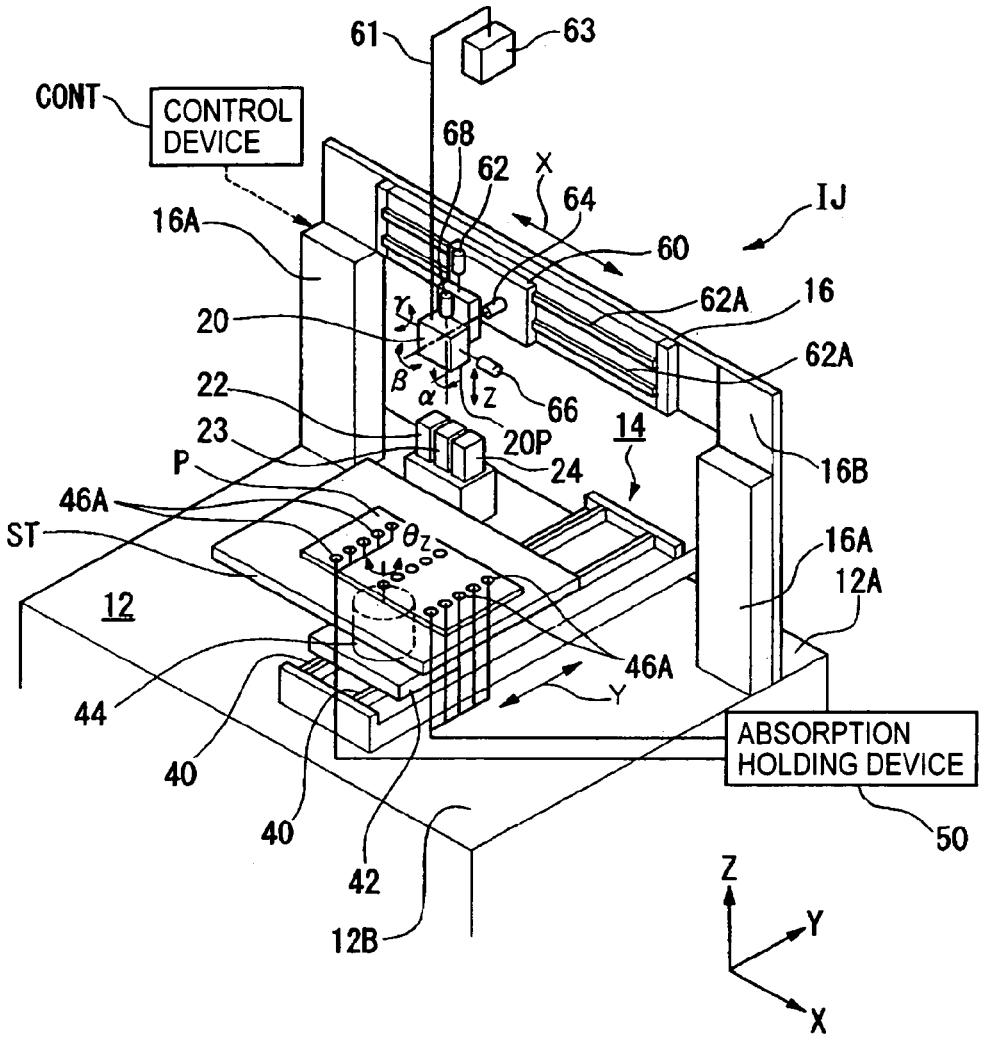
FIG. 1 is a schematic showing a liquid droplet ejection device according to an exemplary embodiment of the present invention.

Hereinafter, a liquid droplet ejection method, a liquid droplet ejection device, a nozzle abnormality determination method, a display device which is manufactured using the liquid droplet ejection device, and an electronic apparatus on which the display device manufactured using the liquid droplet ejection device is mounted, according to exemplary aspects of the present invention, will be described with reference to the accompanying drawings. FIG. 1 is a schematic showing a liquid droplet ejection device according to an exemplary embodiment of the present invention.

Moreover, in the respective drawings which are used in the following description, the respective elements are shown in a recognizable size. Thus scales of the respective elements are suitably changed.

Liquid Droplet Ejection Device

In FIG. 1, a liquid droplet ejection device IJ includes a base 12, a stage ST to support a substrate P on the base 12, a first transfer device 14 interposed between the base 12 and the stage ST to movably support the stage ST, an ejection head 20 to eject a predetermined liquid material with respect to the substrate P which is supported with the stage 14, a second transfer device 16 to movably support the ejection head 20, a tank (liquid material reservoir) 63 in which the liquid material to be ejected from the ejection head 20 is stored, a liquid material flow passage 61 to supply the liquid material to the ejection head 20, a control unit CONT to control an ejection operation of the liquid material of the ejection head 20, a capping unit 22 provided on the base 12, a suction/wipe unit (recovery unit) 23, and a camera unit (imaging device) 24. Further, operations of the liquid droplet ejection device IJ, such as creation of a drive signal which is supplied to the ejection head 20 so as to perform a liquid drop ejection operation, drive control of the first transfer device 14 and a second transfer device 16, operation control of the suction/wipe unit 23, an imaging operation of the camera unit 24 and processing of a captured image, are controlled by the control unit CONT.

The first transfer device 14 is provided on the base 12 and is located along a Y-axis direction. The second transfer device 16 is mounted in an upright state to the base 12 using pillars 16A and 16A and on a rear portion 12A of the base 12. The X-axis direction of the second transfer device 16 is a direction orthogonal to the Y-axis direction of the first transfer device 14. Here, the Y-axis direction is a direction along directions of a front portion 12B and the rear portion 12A of the base 12. The X-axis direction is a direction along horizontal left and right directions of the base 12. Further, a Z-axis direction is a direction vertical to the X-axis direction and the Y-axis direction.

The first transfer device 14 includes, for example, a linear motor, and guide rails 40 and 40 and a slider 42 that is provided movably along the guide rails 40. The slider 42 of the linear motor-type first transfer device 14 can move in the Y axis direction along the guide rails 40 to be located.

Further, the slider 42 includes a motor 44 to rotate around the Z axis (θZ). The motor 44 is a direct drive motor, for example, and a rotor of the motor 44 is fixed to the stage ST. Thus, when the electricity is supplied to the motor 44, the rotor and the stage ST can be made to rotate along the θZ direction.

The stage ST is intended to hold and locate at a predetermined position the substrate P. Further, the stage ST includes an absorption holding device 50, and the substrate P is absorbed and held on the stage ST via a hole 46A of the stage ST by operation of the absorption holding device 50.

The second transfer device 16 includes a linear motor and a column 16B fixed to the pillars 16A and 16A, a guide rail 62A which is supported with the column 16B, and a slider 60 which is movably supported in the X axis direction along the guide rail 62A.

The slider 60 can move in the X axis direction along the guide rail 62A to be located, and the ejection head 20 is mounted in the slider 60.

The ejection head 20 includes motors 62, 64, 66 and 68 as rotational drive devices. If the motor 62 operates, the ejection head 20 moves up and down along the Z axis direction. The Z axis is a direction (up and down direction) orthogonal respective to the X axis and the Y axis. If the motor 64 operates, the ejection head 20 rotates in a β direction of rotation around the Y axis. If the motor 66 operates, the ejection head 20 rotates in a γ direction of rotation around the X axis. If the motor 68 operates, the ejection head 20 rotates in a α direction of rotation around the Z axis. Specifically, the second transfer device 16 movably supports movably the ejection head 20 in the X axis direction and the Z axis direction. Further, the second transfer device 16 rotatably supports the ejection head 20 in a θX direction (rotation around the X axis), a θY direction (rotation around the Y axis) and a θZ direction (rotation around the Z axis).

In such a manner, in the slider 60, the ejection head 20 of FIG. 1 moves in a straight line in a Z axis direction and rotates along α, β and γ. Thus, a position or posture of a nozzle forming surface 20P of the ejection head 20 to the substrate P at the side of the stage ST can be controlled accurately. Moreover, in the nozzle forming surface 20P of the ejection head 20, a plurality of nozzles to eject a liquid material is provided.

Next, a structure of the ejection head 20 will be described with reference to FIGS. 2 and 3.

Figure 2:
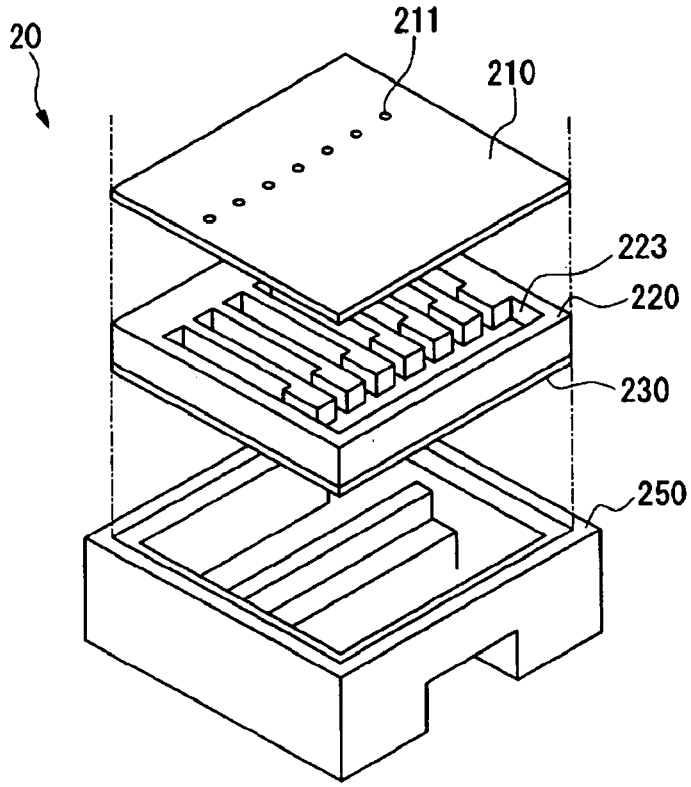
FIG. 2 is a schematic of an ejection head.
Figure 3:
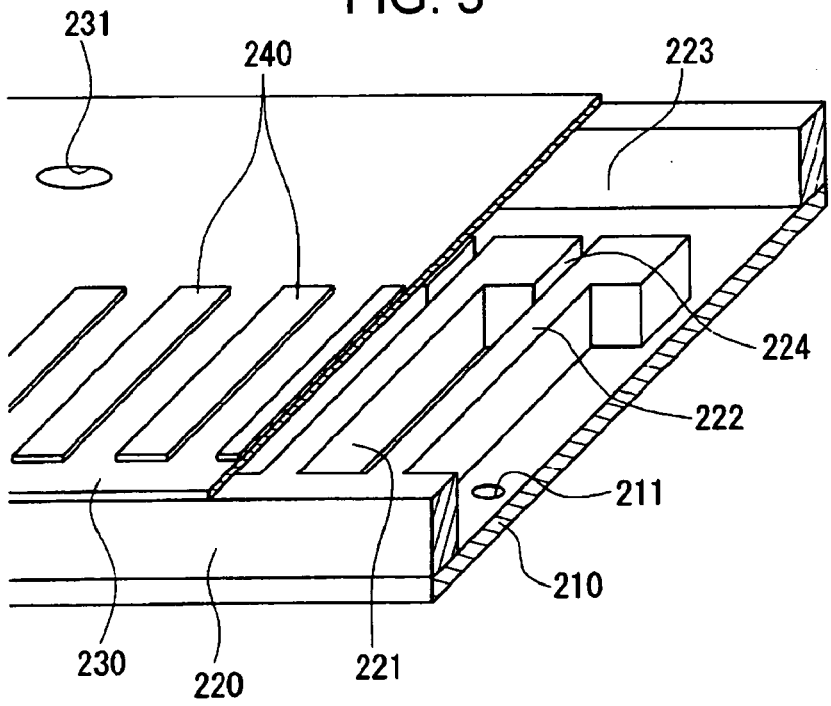
FIG. 3 is a schematic of elements of the ejection head.

FIG. 2 is schematic showing an ejection head, and FIG. 3 is a partial cross-sectional view of FIG. 2.

As shown in FIG. 2, the ejection head 20 is constructed by inserting a pressure chamber substrate 220, in which a nozzle plate 210 provided with a plurality of nozzles and a vibration plate 230 are provided, into a housing 250. The structure of essential elements of the ejection head 20 is a structure in which the pressure chamber substrate 220 is interposed between the nozzle plate 210 and the vibration plate 230, as shown in FIG. 3. At a position corresponding to a cavity 221 when the nozzle plate 210 is joined to the pressure chamber substrate 220, a nozzle 211 is formed. In the pressure chamber substrate 220, by etching a substrate made of silicon single crystal, a plurality of cavities 221 is provided such that each cavity 221 functions as a pressure chamber. The cavities 221 are separated from each other by sidewalls (partition walls) 222. The cavities 221 are connected to a common flow passage. Specifically, a reservoir 223 via supply ports 224. The vibration plate 230 is made of, for example, a thermal oxidized film. In the vibration plate 230, a liquid material tank slot 231 is provided such that an arbitrary liquid material is supplied from the tank 63 of FIG. 1 via the liquid material flow passage 61. In positions on the vibration plate 230 corresponding to the cavities 221, piezoelectric elements (ejection unit) 240 are formed. Each of the piezoelectric elements 240 has a structure with piezoelectric ceramics crystal, such as a piezo element interposed between an upper electrode and a lower electrode (not shown). The piezoelectric element 240 is constructed such that its volume is changed according to a voltage waveform of a drive signal which is supplied from the control unit CONT.

Further, the nozzle plate 210 shown in FIGS. 2 and 3 is made of a metallic material, such as stainless steel. Further, in particular, from the inside to the peripheral portion of the nozzle 211, a thin film is formed as a surface film by film-forming processing such as eutectic plating. Further, it is constructed such that a lyophobic property is mainly secured in the peripheral portion of the nozzle 211.

In order to allow the liquid material to be ejected from the ejection head 20, first, the control unit CONT supplies a voltage waveform to eject the liquid material to the ejection head 20. The liquid material flows into the cavity 221 of the ejection head 20, and if an ejection signal is supplied to the ejection head 20, the piezoelectric element 240 generates a change in volume by a voltage applied between the upper electrode and the lower electrode. By the change in volume, the vibration plate 230 is deformed, and then a volume of the cavity 221 changes. As a result, liquid droplets of the liquid material are ejected from the nozzle 211. To the cavity 221 of which the liquid material is ejected, a liquid material is newly supplied from the tank by the ejected amount.

Moreover, the ejection head is constructed such that the liquid material is ejected by the change in volume of the piezoelectric element. But it may be constructed such that liquid droplets are ejected when the liquid material is heated by a heating element to be expanded. Further, the ejection head may be constructed such that the liquid droplets are ejected by the change in volume generated when the vibration plate is deformed by static electricity.

The second transfer device 16 is intended to move the ejection head 20 in the X axis direction, such that the ejection head 20 can be selectively located at an upper portion of the suction/wipe unit 23 or the capping unit 22. Specifically, while working for the manufacture of the device, for example, if the ejection head 20 moves above the suction/wipe unit 23, cleaning of the ejection head 20 or recovery of a defective nozzle can be performed. If the ejection head 20 moves above the capping unit 22, it becomes possible to cap the nozzle forming surface 20P of the ejection head 20, fill the cavity 221 with the liquid material, and recover defective ejection. Specifically, the suction/wipe unit 23 and the capping unit 22 are arranged just below a transfer path of the ejection head 20 in the rear portion 12A on the base 12, with being spaced apart from the stage ST. Since the substrate P is carried in and out of the stage ST at the side of the front portion 12B of the base 12, there are no difficulties in working due to the suction/wipe unit 23 or the capping unit 22.

Further, as the liquid material to be ejected from the ejection head 20, for example, an ink containing colored materials which are used to form color filters, a dispersing solution containing materials, such as metallic fine particles, which are used to form metallic wiring lines, a solution containing organic electroluminescent materials of hole injecting/transporting materials or light emitting materials, such as PEDOT:PSS, which are used to form organic electroluminescent devices, a functional liquid having high viscosity, such as liquid crystal materials which are used to form liquid crystal devices, a functional liquid containing materials which are used to form microlenses, a bio-polymer solution, such as proteins which are used to form micro arrays, such as DNA chips may be included. That is, liquid materials containing materials according to various objects can be adapted.

Further, the substrate P may be made of a transparent substrate, such as a glass substrate which is representative of transparent materials, a resin substrate made of plastics, and a metallic substrate.

The capping unit 22 functions to cap the nozzle forming surface 20P and hold the nozzle forming surface 20P of the ejection head 20 in a wet state so as not to be not dried, in a state in which the liquid droplet ejection device IJ does not perform the ejection of the liquid droplets, for example, in a standby state, such as a state in which the substrate P is carried in and carried out of the liquid droplet ejection device IJ.

Suction/Wipe Unit

Figure 4:
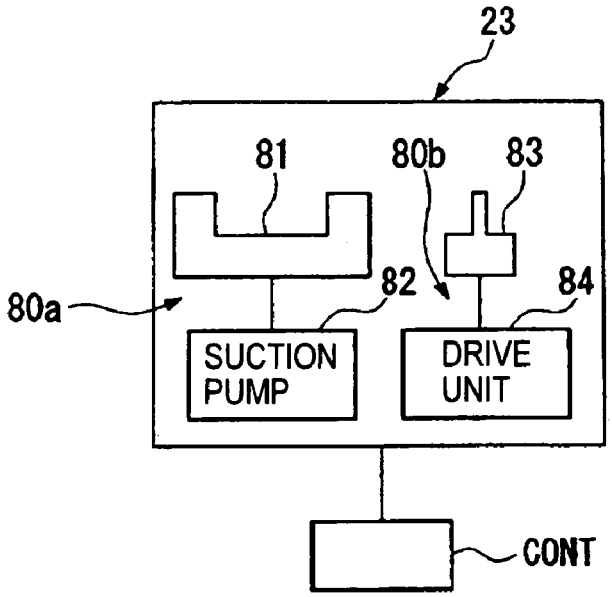
FIG. 4 is a schematic showing a construction of a suction/wipe unit.

FIG. 4 is a schematic showing a construction of a suction/wipe unit. The suction/wipe unit 23 includes a suction unit 80*a* and a wiping unit 80*b*, as shown in FIG. 4.

The suction unit 80*a* includes a cap 81 and a suction pump 82. The suction unit 80*a* covers the ejection head 20 with the cap 81 and is decompressed within the cap 81 by the suction pump 82. By the decompression reaction, the suction unit 80*a* sucks bubbles or the liquid material within the ejection head 20. In this situation, since the cap 81 is made to cover entirely the plurality of nozzles, when the suction operation is performed, the liquid material is sucked in from all the nozzles.

The wiping unit 80*b* includes a wiper 83 and a drive unit 84. The wiping unit 80*b* drives the wiper 83 in a state in which the wiper 83 and the nozzle forming surface 20P of the ejection head 20 contacts each other, such that the nozzle forming surface 20P is wiped.

Such a suction/wipe unit 23 is made to clean the nozzle forming surface 20P of the ejection head 20 or recover the defective nozzle during the operation or the standby state of the liquid droplet ejection device IJ. This cleaning or recovery operation can be performed periodically, at every predetermined operation time or at any time. The suction/wipe unit 23 is also made to operate according to a program stored in the control unit CONT. Further, the suction/wipe unit 23 may operate in connection with the camera unit 24 described below.

Further, such a wiping unit 80*b* may be made to perform the wiping operation in a direction orthogonal to the direction in which the plurality of nozzles 211 shown in FIG. 2 is arranged. In such a manner, during the wiping operation, it is possible to reduce the likelihood or prevent the liquid material attached to the wiper 83 from entering into the nozzles 211.

Moreover, in the suction/wipe unit 23, the wiper 83 is driven. However, while the wiper 83 may be fixed, the ejection head 20 may move and rub against the wiper 83, whereby the wiping operation is performed.

Camera Unit

Figure 5:
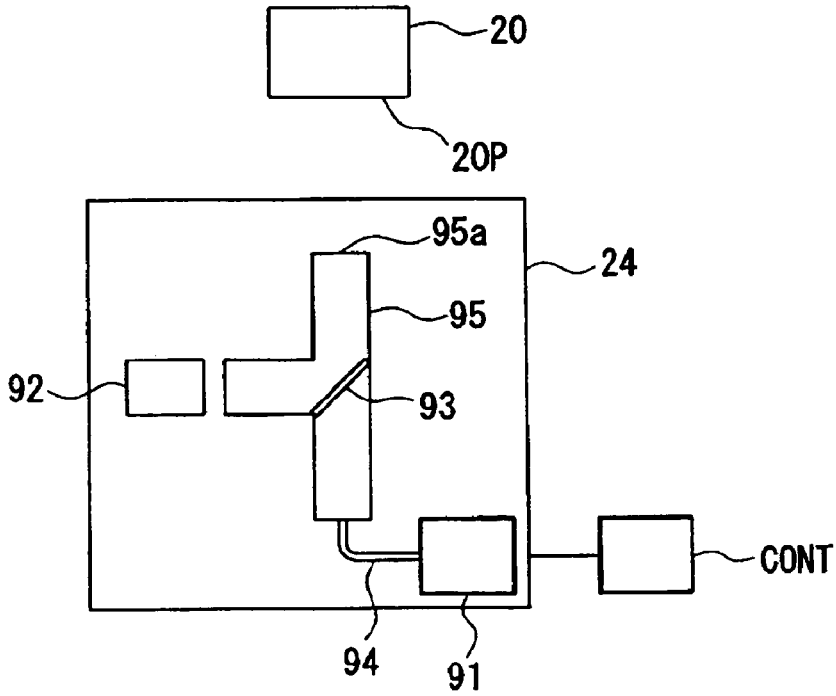
FIG. 5 is a schematic showing a construction of a camera unit.

FIG. 5 is a schematic showing a construction of the camera unit 24.

As shown in FIG. 5, the camera unit 24 includes an imaging unit 91, an illumination unit 92, a semitransparent mirror 93, an optical fiber cable 94 and a barrel 95, and is connected to the control unit CONT.

The imaging unit 91 is a camera made of CCD or CMOS sensors. The illumination unit 92 is made of halogen lamps, tungsten lamps, LED lamps or the like. The semitransparent mirror 93 reflects illumination of the illumination unit 92 to a side of an exit slot 95*a* of the barrel 95 and transmits an image of an imaged object such that the imaging unit 91 receives the image. The optical fiber cable 94 is intended to transmit the image of the imaged object incident to the barrel 95 to the imaging unit 91. The barrel 95 includes a lens that is not shown. The illumination amount of the illumination unit 92 or the optical magnification of the lens (not shown) is controlled by the functions of the control unit CONT, based on the imaged object.

The camera unit 24 sets the captured image from the inside of the nozzle of the ejection head 20 to its peripheral portion. The imaging unit 91 receives the image of the imaged object as a monochrome image or a color image, images the imaging object in a predetermined magnification, images the detailed portion of the imaging object at a magnified scale, or images the imaging object at a reduced scale to view overall the imaging object, by the functions of the control unit CONT. For example, by adjusting the magnification, about 10 to 20 nozzles or about 2 to 5 nozzles among the plurality of nozzles on the nozzle forming surface 20P can be viewed. Image data imaged by the imaging unit 91 is transmitted to the control unit CONT.

Control Unit

Figure 6:
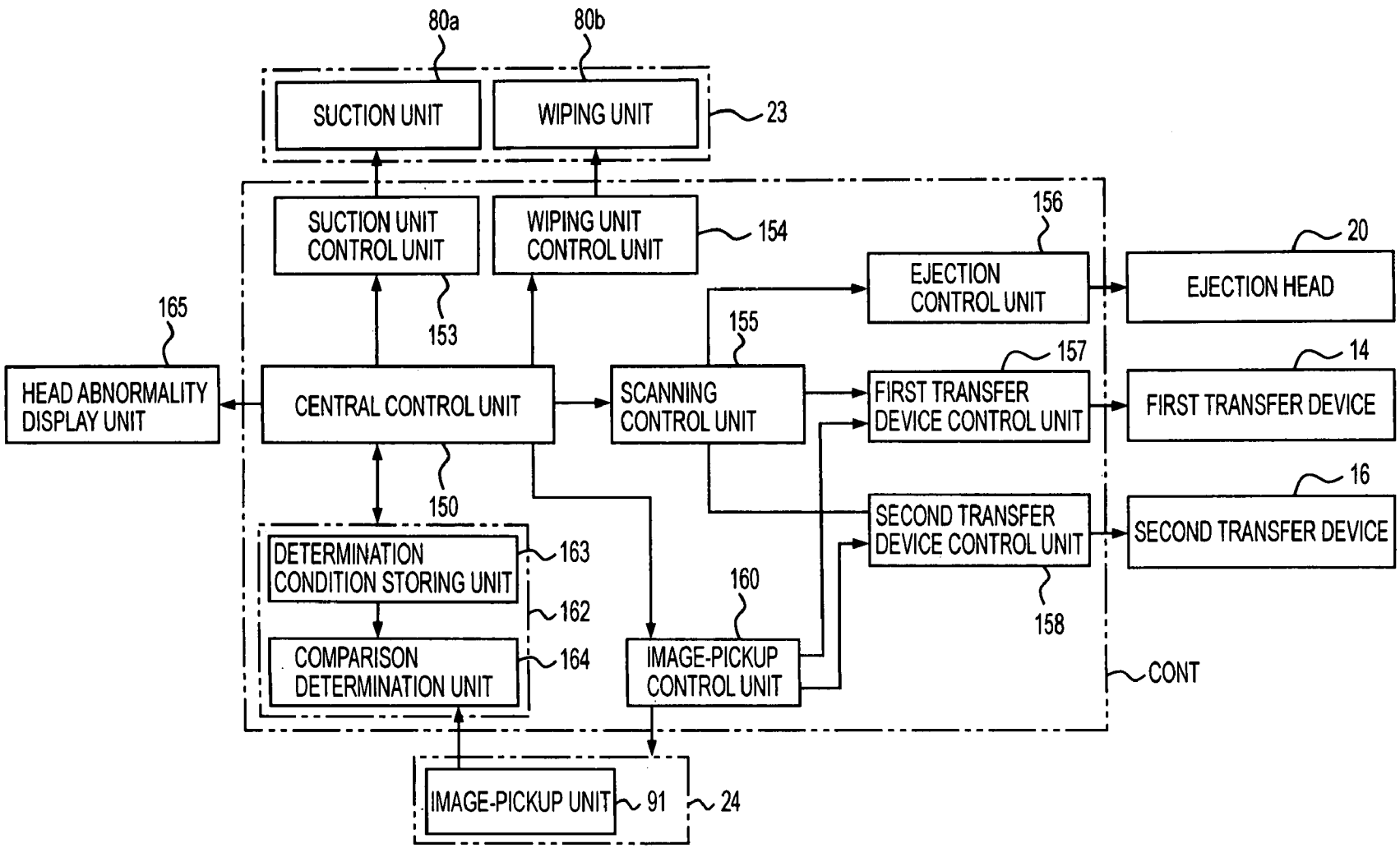
FIG. 6 is a block schematic of the liquid droplet ejection device.

Next, the control unit will be described with reference to FIG. 6. FIG. 6 is a block schematic of a liquid droplet ejection device.

In FIG. 6, the control unit CONT includes a central control unit 150 which unifies the overall operation controls of the liquid droplet ejection device IJ. The control unit CONT may include a suction unit control unit 153 and a wiping unit control unit 154 to perform the operation control of the suction/wipe unit 23 (see FIG. 4), a scanning control unit 155 to perform the scanning control and the ejection control of pattern printing together, an imaging control unit 160 to perform the imaging control of the camera unit 24, and a determination unit 162 to determine the quality of the ejection performance of the imaged nozzle.

The scanning control unit 155 can synchronously control an ejection control unit 156 to perform the ejection control of the ejection head 20, a first transfer device control unit 157 (see FIG. 1) to perform the drive control of the first transfer device 14 (see FIG. 1), and a second transfer device control unit 158 to perform the drive control of the second transfer device 16 (see FIG. 1). Then, by the control of the scanning control unit 155, the pattern printing described below is performed. Further, the scanning control unit 155 also functions to control an imaging position of the ejection head 20 by the above-mentioned camera unit 24.

The imaging control unit 160 performs controls of the illumination amount of the illumination unit 92, the selection of the monochrome image or the color image, or the magnification of the imaging object, as described above. Further, the imaging control unit 160 controls the first transfer device control unit 157 and the second transfer device control unit 158 and change a relative position of the camera unit 24 and the ejection head 20, to thereby control the position of the imaging object.

By the functions of the imaging control unit 160, for the respective objective nozzles, an image which can recognize at least one of a state of a meniscus inside the nozzle, the shape of a nozzle opening and states of surface films (thin film) formed inside and outside the nozzle is acquired, and the acquired image is forwarded to the determination unit 162.

The determination unit 162 includes a determination condition storing unit 163 in which image information (hereinafter, "a reference image") of the normal nozzle is previously stored, relating to an outline shape of the nozzle or the states of the thin films. Further, the determination unit 162 may include a comparison determination unit 164 that compares the image transmitted from the imaging unit 91 with the reference image and determines abnormality of the nozzle. Moreover, the reference image is stored by an input of a user or through an electrical communication line.

The reference image is image data of the normal nozzle shape, for example. The normal nozzle shape is compared with a nozzle shape imaged by the camera unit 24, and then it is determined whether the imaged nozzle is abnormal or normal. Further, in addition to the simple determination of abnormality or normality of the nozzle, an abnormality degree of the nozzle is determined. For example, it is determined whether the abnormality of the nozzle is such a degree that the nozzle can be recovered by the suction/wipe unit (recovery unit) 23 (first abnormality) or the abnormality of the nozzle is such a degree that an exchange of the ejection head 20 is indispensable (second abnormality). The determination result of the determination unit 162 is transmitted to the central control unit 150.

Liquid Droplet Ejection Method

A liquid droplet ejection method as a printing method of printing patterns onto the substrate P will now be described. To begin with, a liquid droplet ejection operation of the ejection head 20 will be described, and then the operation of the liquid droplet ejection device IJ will be described. Finally, the determination of the ejection performance of the nozzle will be described.

Liquid Droplet Ejection Operation of Ejection Head

First, the liquid droplet ejection operation in the ejection head 20 will be specifically described with reference to FIGS. 7 and 8.

FIG. 7 is a schematic showing an example of a voltage waveform of a drive signal which is supplied to the ejection head. Further, FIG. 8 is a schematic showing essential parts of the nozzle, in which states of the liquid material in the nozzle are shown according to the change in a voltage waveform.

The voltage waveform V(t) shown in FIG. 7 which is generated in the ejection control unit 156 (see FIG. 6) is supplied to a piezoelectric element 240 of the ejection head 20, and the ejection head 20 ejects the liquid material in the shape of a liquid droplet.

The liquid droplet ejection process will now be specifically described. The liquid droplet of one droplet is ejected from the nozzle through the following periods: a period t0 to t1 in which a potential V1 is supplied to the piezoelectric element 240 to maintain a stable state; a period t1 to t2 in which a potential V2 is supplied to the piezoelectric element 240 to expand the cavity 221 of the ejection head 20; a period t2 to t3 in which the expansion of a space 15 of the ejection head 20 is maintained; a period t3 to t4 in which a potential V3 is supplied to the piezoelectric element 240 to contract the cavity 221 of the ejection head 20; a period t4 to t5 in which the contraction of the cavity 221 of the ejection head 20 is maintained; and a period t5 to t6 in which the potential V1 is supplied to the piezoelectric element 240 to release the contraction of the cavity 221 of the ejection head 20.

Moreover, in the liquid droplet ejection operation of the ejection head, the number of liquid droplets to be ejected from the nozzle (the number of liquid droplet ejection times) is counted in the central control unit 150 (see FIG. 6).

With respect to such a voltage waveform shown in FIG. 7, a state in which the liquid material is changed in the vicinity of the nozzle 211 will be described with reference to FIGS. 8A-8D.

In the period t0 to t1, a liquid surface portion (meniscus) of the liquid material Q within the nozzle 211 is in a stable state within the nozzle 211. In the inside of the nozzle 211, the meniscus has a concave surface shape as viewed from the side of the nozzle forming surface 20P, as described below. Since the meniscus is formed in the concave surface shape within the nozzle 211, the liquid droplet is normally ejected from the nozzle 211. Further, the shape of the nozzle 211 is normal as viewed from the side of the nozzle forming surface 20P. In a case in which the shape of the nozzle 211 is abnormal, a defective ejection of the liquid droplet, a curved flight of the liquid droplet and an error of the amount of the liquid droplet may be caused, such that it is impossible to perform a normal liquid droplet ejection. When the meniscus is not formed in the concave surface shape, a defective ejection of the liquid droplet, a curved flight of the liquid droplet and an error of the amount of the liquid droplet may be caused, such that it is impossible to perform a normal liquid droplet ejection.

In the period t1 to t2, since the potential V2 is supplied to the piezoelectric element 240, the cavity 221 is expanded. Thus the liquid material Q in the vicinity of the nozzle 211 is attracted to the side of the cavity 221.

In the period t3 to t4, since the potential V3 is supplied to the piezoelectric element 240, the expanded cavity 221 is gradually contracted. Then the liquid material Q is pressed out of the nozzle 211.

In the period t4 to t6, the potential V3 is entirely supplied to the piezoelectric element 240, the liquid material Q from the nozzle 211 takes a liquid droplet shape, and then the nozzle 211 ejects the liquid droplet Q'. If the liquid droplet Q' is ejected, at that moment, the liquid material Q in the nozzle 211 vibrates to be an unstable state. However, in the period t5 to t6, the potential of the piezoelectric element 240 returns from V3 to V1, and then the cavity 221 expands somewhat, such that the vibration of the liquid material Q in the nozzle 211 is suppressed. In such a manner, after ejecting the liquid droplet Q', the liquid material Q maintains a stable state in the nozzle 211. Thus, the meniscus is formed in a concave surface shape again, and the next liquid droplet is ready to be ejected.

As described above, in the ejection head 20, the liquid material Q from the nozzle 211 is made in a liquid droplet shape according to a voltage waveform V(t) to be supplied to the piezoelectric element 240, and then the liquid droplet Q' is ejected.

Then, in particular, the meniscus of the liquid material Q in the nozzle 211is formed in a favorable concave surface shape and the shape of the nozzle 211 is normal. Thus, the ejection state of the liquid droplet Q' becomes normal. Further, the curved flight of the liquid droplet Q' is suppressed, the liquid droplet amount becomes uniform and the suitable land precision is obtained, without causing the defective ejection.

Operation of Liquid Droplet Ejection Device IJ

Next, the operation of the liquid droplet ejection device IJ will be specifically described with reference to FIGS. 1 and 6.

First, in FIG. 1, the transfer device (not shown) transfers the substrate P to the stage ST from the front portion 12B of the stage ST. the stage ST absorptively holds and locates the substrate P. Then, if the motor 44 operates, the end surface of the substrate P is set parallel to the Y axis direction.

Next, the ejection head 20 is filled with the liquid material, and then a pattern printing is performed. The pattern printing is performed such that while relatively moving (scanning) the ejection head 20 and the substrate P in X axis direction/Y axis direction, the liquid material is ejected onto the substrate P in a predetermined width from a predetermined nozzle of the ejection head 20.

Specifically, first, while moving the ejection head 20 in the +X direction with respect to the substrate P, the ejection operation is performed. If the ejection head 20 and the substrate P complete once relative move (scanning), the stage ST to support the substrate P moves in a step-wise manner with respect to the ejection head 20 in the Y axis direction. Then, while relatively moving (scanning) the ejection head 20, for example, in the −X direction with respect to the substrate P again, the ejection operation is performed. By repeating these operations a plural number of times, the ejection head 20 ejects the liquid material based on the control of the scanning control unit 155, such that a predetermined pattern is formed on the substrate P. Then, the absorptive holding by the stage ST is released, and the transfer device transfers the substrate P from the stage ST.

Such a scanning control is performed by synchronously controlling the respective control units of the ejection control unit 156, the first transfer device control unit 157 and the second transfer device control unit 158 by the scanning control unit 155 shown in FIG. 6.

In a liquid droplet ejection method such a liquid droplet ejection device IJ, the corrosive liquid material is ejected, and thus the nozzle is exposed to the corrosive liquid material. Thus, the outline of the nozzle is corroded to be distorted, the diameter of the nozzle is enlarged, or the removal of the thin film is caused. As a result, there may be cases in which the defective ejection of the liquid droplets, the curved flight of the liquid droplets, and the error of the liquid droplet amount are caused. In this situation, it is not possible to perform the normal ejection of the liquid droplets.

Further, since the meniscus in the nozzle may be broken according to the liquid droplet ejection, there may also be cases in which the defective ejection of the liquid droplets, the curved flight of the liquid droplets, and the error of the liquid droplet amount, are caused. In this situation, it is not possible to perform the normal ejection of the liquid droplets.

In such a manner, the ejection performance of the nozzle is lowered due to the operation history of the liquid droplet ejection device IJ. As a solution thereof, it is needed to image the nozzle of the ejection head 20, compare the image of the imaged nozzle with the reference image previously stored in the determination condition storing unit 163, and determine whether the imaged nozzle is normal or abnormal.

Specifically, it is needed to compare the shape of the imaged nozzle with the shape of the normal nozzle previously stored in the determination condition storing unit 163, and determine whether the imaged nozzle is abnormal or normal and whether the abnormality is the extent that can be recovered by the suction/wipe unit 23 or the extent that the exchange of the ejection head 20 is required.

Further, it is needed to image the nozzle of the ejection head 20, confirm whether or not the defective nozzle having a broken meniscus exists, and, when the defective nozzle exists, recover the defective nozzle by means of the suction/wipe unit 23.

First Example of Ejection Performance Determination of Nozzle

Next, a first example of an ejection performance determination of the nozzle will be described with reference to FIGS. 6, 9, 10 and 11.

Figure 9:
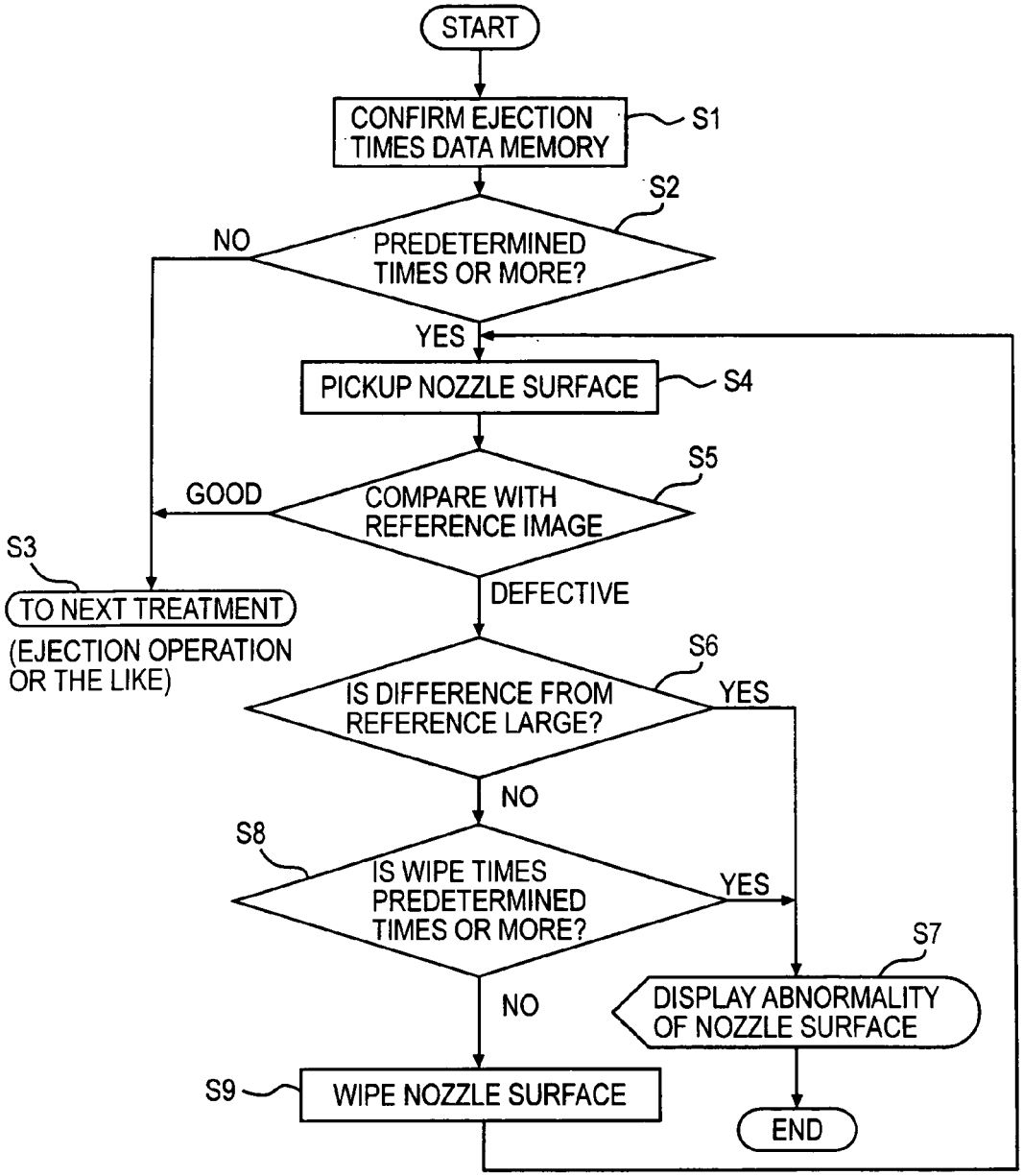
FIG. 9 is a flowchart showing an example of a nozzle abnormality determination processing.

FIG. 9 is a flowchart showing an example of a nozzle abnormality determination processing. In this flowchart, the overall flow is generally managed by the central control unit 150 of FIG. 6.

First, as described in the "liquid droplet ejection operation of the ejection head", data (data memory of the number of ejection times) of the number of ejection times of the ejection head 20 that is counted by the central control unit 150 is confirmed (step 1). Moreover, the number of ejection times described herein represents an average value for each nozzle.

Next, it is determined whether the number of ejection times of the liquid droplets ejected from the ejection head 20 is more or less than the predetermined number of times (step 2). Here, the predetermined number of times is the number of times previously set in the central control unit 150.

Then, if the number of ejection times is less than the predetermined number of times (in case of NO), it is determined that it is not necessary to image the shape of the nozzle, and then the process progresses to a next processing, such as a liquid droplet ejection operation (step 3).

Further, if the number of ejection times is more than the predetermined number of times (in case of YES), it is determined that it is necessary to image the shape of the nozzle, and then a nozzle abnormality determination method described below is performed.

Next, the imaging of the nozzle surface is performed to image the nozzle forming surface 20P of the ejection head 20 (step 4). Specified operations will be described with reference to FIGS. 1 and 5. First, the first transfer device 14 and the second transfer device 16 in FIG. 1 are driven, the ejection head 20 moves to a position opposing the exit slot 95*a* of the barrel 95 of the camera unit 24. Next, if the illumination unit 92 in FIG. 5 exits illumination light, the semitransparent mirror 93 reflects illumination light to the side of the exit slot 95*a*. Then, the image of the nozzle forming surface 20P illuminated by illumination light transmits the semitransparent mirror 93 and is received by the imaging unit 91 via the optical fiber cable 94.

Such an imaging of the nozzle surface is made by the control of the imaging control unit 160 of FIG. 6. As a result, in the imaging unit 91, the image of the peripheral portion of the nozzle, and in particular, in the present example, the image which can recognize the outline of the nozzle and the state of the thin film in the vicinity of the nozzle is acquired, and the acquired image is transmitted to the determination unit 162.

Returning to FIG. 9 again, it is determined whether the nozzle is abnormal or normal from the image of the imaged nozzle (step 5).

The determination is performed in the comparison determination unit 164 by comparing the image of the peripheral portion of the imaged nozzle with the reference image previously stored in the determination condition storing unit 163.

Specifically, for example, by comparing the shape of the nozzle with the shape of the normal nozzle serving as the determination reference, it is determined whether the nozzle is abnormal or normal, that is, it is determined whether or not the diameter of the nozzle is enlarged, whether or not the outline of the nozzle is defective, or whether or not the thin film (eutectic plating) in the vicinity of the nozzle is removed. The determination result is transmitted to the central control unit 150.

Then, if it is determined that the imaged nozzle is normal (in case of "good"), since it is not necessary to recover the nozzle or exchange the ejection head 20, the process progresses to the next processing, such as the liquid droplet ejection operation (step 3).

Further, if it is determined that the nozzle is abnormal (in case of "defective"), the process progresses to the next step 6.

Figure 10A:
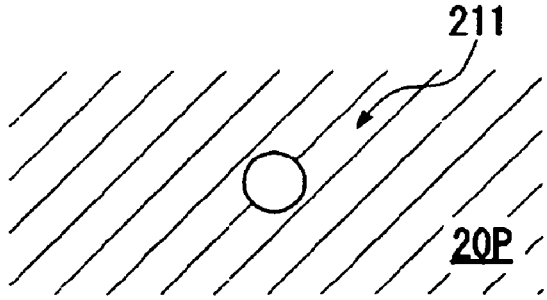
FIG. 10A is a schematic showing a state of a normal nozzle.
Figure 10B:
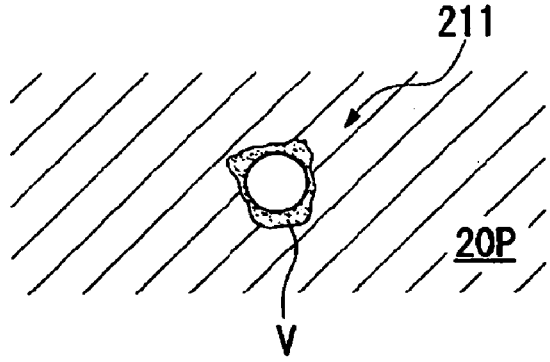
FIG. 10B is a schematic showing an example of a nozzle which is determined as abnormal.
Figure 10C:
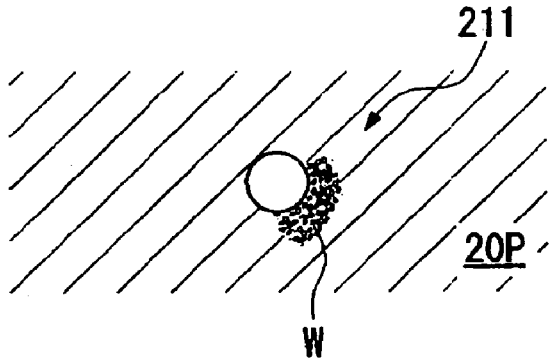
FIG. 10C is a schematic showing another example of a nozzle which is determined as abnormal.
Figure 10D:
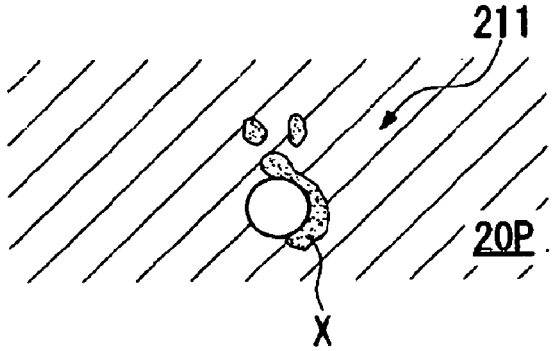
FIG. 10D is a schematic showing still another example of a nozzle which is determined as abnormal.

Here, an example of the determination result that the shape of the nozzle is abnormal in the nozzle forming surface 20P will be described with reference to the FIGS. 10A-10D. FIGS. 10A-10D show an image imaged by the imaging unit 91. FIG. 10A is a schematic showing the shape of the normal nozzle as the determination reference. FIGS. 10B-10D are schematics showing the shapes of the nozzles which are determined as abnormal.

As shown in FIG. 10A, in the normal nozzle, corrosion on the nozzle forming surface 20P is not observed, and the thin film (eutectic plating or the like) on the nozzle forming surface is not removed.

As shown in FIGS. 10B-10D, in the nozzles which are determined as abnormal, on the nozzle forming surface 20P, the distorted outlines and the corroded portions V, W and X which are the corroded positions of the thin film are observed. The corrosion is a portion formed by being exposed to the corrosive liquid material. In a state in which such portions exist, if the liquid droplet ejection is performed, the problems, such as the defective ejection, the lowering of the land precision, and the generation of the mist are caused.

The nozzles in which the corroded portions V, W and X shown in FIGS. 10B to 10D are observed are determined as abnormal by the determination unit 162 which compares them with the normal nozzle of FIG. 10A.

Returning to FIG. 9 again, in the step 6, it is determined how the extent of the abnormality of the nozzle that is determined as abnormal at the step 5 is. This determination is also performed in the determination unit 162, similar to the step 5, and the determination result is transmitted to the central control unit 150.

Specifically, it is determined whether the abnormality of the nozzle is the extent that can be recovered by the suction/wipe unit 23 (the first abnormality) or the extent that the exchange of the ejection head 20 is required (the second abnormality). Then, if the difference of the abnormal nozzle from the normal nozzle is large (in case of YES), it is determined that the ejection head 20 is defective, and the central control unit 150 instructs a display unit (head abnormality display unit 165), such as a display device to display a message representing the abnormality of the nozzle surface and a message promoting the exchange of the ejection head 20 (step 7). Subsequently, the nozzle abnormality determination method is completed.

Further, if the difference of the abnormal nozzle from the normal nozzle is small (in case of NO), the process progresses to the next step S8.

At the step 7, in the case in which the abnormality of the nozzle surface is displayed, based on the display of the display device, the operator exchanges the ejection head and starts the liquid droplet ejection device IJ again. Thus, the liquid droplet ejection device IJ can be favorably operated.

Moreover, with regard to the exchange of the ejection head 20, the liquid droplet ejection device IJ may include an exchange unit to exchange the ejection head, such that the exchange of the ejection head may be automatically performed.

Here, examples of the nozzle having abnormality to the extent that can be recovered by the suction/wipe unit 23 and the nozzle having abnormality to the extent that the exchange of the ejection head 20 is required will be described with reference to FIGS. 11A and 11B.

Figure 11A:
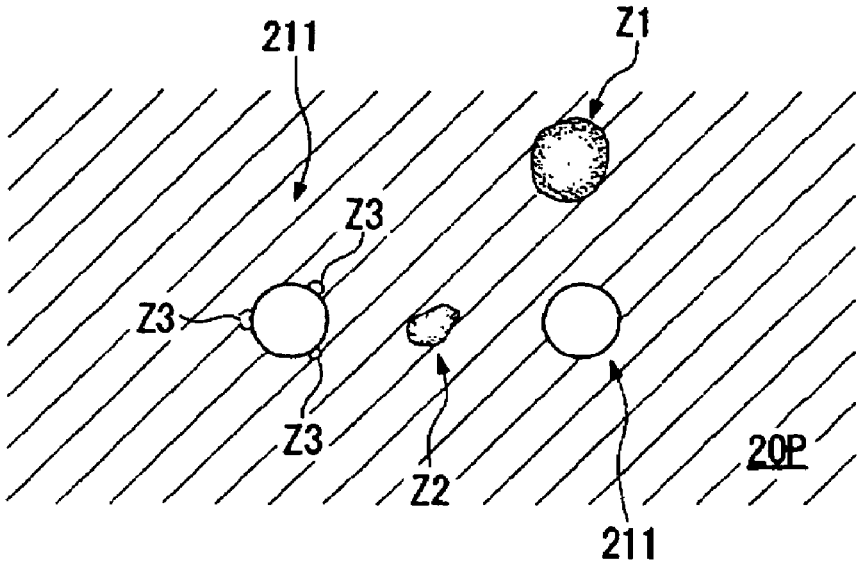
FIG. 11A is a schematic showing an example of a state of a nozzle which can be recovered by wiping.

FIG. 11A is a schematic showing the nozzle having abnormality to the extent that can be recovered by wiping. FIG. 11B is a schematic showing the nozzle having abnormality to the extent that the exchange of the ejection head 20 is required.

In FIG. 11A, on the nozzle forming surface 20P, the corroded portions made of the thin film denoted by the reference numerals Z1 to Z3 are observed in the vicinity of the nozzle 211. Further, the thin film in the vicinity of the nozzle 211 is not removed. In such a nozzle forming surface 20P, the corroded portion Z3 is formed in the peripheral portion of the nozzle 211. However, in this case, in the determination unit 162, as compared with the shape of the normal nozzle, it is determined that corrosion does not cause the defective ejection, the lowering of the land precision and the generation of the mist, and further it is determined that the abnormality can be recovered by wiping.

Figure 11B:
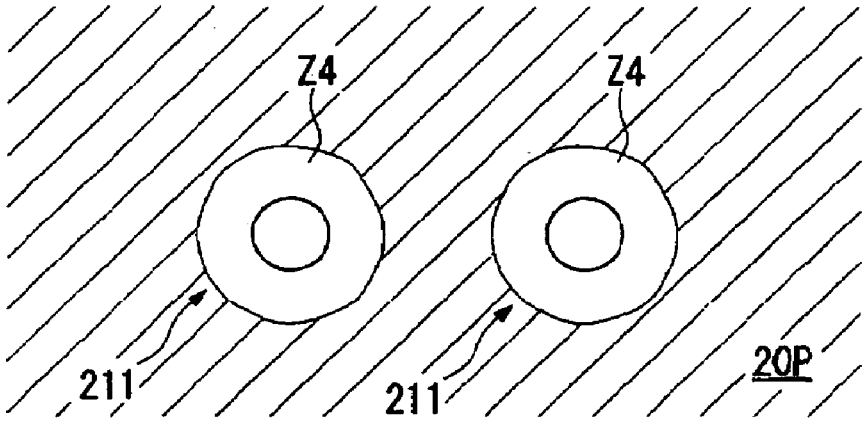
FIG. 11B is a schematic showing an example of a state of a nozzle in which an ejection head 20 needs to be exchanged.

Further, in FIG. 11B, the thin film in the vicinity of the nozzle 211 is entirely removed, and the removed portion Z4 is exposed. In such a nozzle forming surface 20P, in the determination unit 162, as compared with the shape of the normal nozzle, it is determined that the defective ejection, the lowering of the land precision and the generation of the mist are caused. Further it is determined that the exchange of the ejection head 20 is required.

Returning to FIG. 9 again, in the step 8, it is determined whether or not the number of wiping times of the nozzle forming surface 20P is more than the predetermined number of times. Specifically, by comparing the number of wiping times counted by the central control unit 150 with the predetermined number of times previously set in the central control unit 150, it is determined whether or not the number of wiping times is more than the predetermined number of times.

Then, if the number of wiping times is more than the predetermined number of times (in case of YES), the process progresses to the step 7, and the above-mentioned processings are performed.

Further, if the number of wiping times is less than the predetermined number of times (in case of NO), the process progresses to the step 9. Then, the central control unit 150 instructs the wiping unit control unit 154 to wipe the nozzle surface. And then, wiping is performed on the nozzle forming surface 20P by the wiping unit 80*b* of the suction/wipe unit 23, and the process returns to the step 4.

As described above, in the present example, unlike a technique in which abnormality of a liquid material (ink), a bubble-like residual of the ink or a stain of the ink attached to a nozzle unit is observed as in the related art, after imaging the peripheral portion of the nozzle, the shape of the imaged nozzle is compared with the shape of the normal nozzle, such that abnormality of the nozzle is determined. Thus, it is possible to discover the abnormal nozzle early and surely. Since there is no liquid droplet to be ejected in a state in which the abnormal nozzle remains, it is possible to reduce the likelihood or prevent defective ejection of liquid droplets, a curved flight of liquid droplets, deterioration of landing precision, variation of the amount of liquid droplets, or generation of mist due to the abnormal nozzle.

Further, in such a manner, an abnormal nozzle is discovered early. Thus it is possible to recover an abnormal nozzle or to exchange an ejection head, before various defective products to be formed using a liquid droplet ejection method are produced in large quantities. Thus, it is possible to reduce defect costs. Since it is completed without the defective products, it is possible to reduce manufacturing costs.

Further, when an operator views an image of the peripheral portion of the nozzle to determine abnormality, it is possible for the operator to determine abnormality of the nozzle based on the operator's knowledge or experience.

Further, when the image processing or the like is performed using the control device CONT, it is possible to perform automatically the determination of nozzle abnormality.

Further, by recovering the abnormal nozzle or exchanging the ejection head 20 having the abnormal nozzle, it is possible to make all the nozzles in the ejection head 20 have a favorable state such that normal ejection is possible. Therefore, it becomes possible to eject the liquid droplets according to the voltage waveform V(t) supplied to the piezoelectric element 240, and it is possible to attain high precision of land position of the liquid droplets, variation reduction of the liquid droplet amount, prevention of the curved flight or suppression of mist.

Further, by determining abnormality or normality of the nozzle, when it is determined that the nozzle is normal, the nozzle may be used as it is, and when it is determined that the nozzle is abnormal, the nozzle may be recovered or the ejection head may be exchanged. Thus, as compared with simple regular recovery of the nozzle or exchange of the ejection head, it is not necessary to perform a useless recovery operation to the normal nozzle and to exchange uselessly the ejection head 20 having the normal nozzle. That is, it is possible to perform suitably the recovery process or the exchange process.

Further, in the case in which the determination result in the control device CONT is to the extent that the nozzle can be recovered by wiping, the abnormal nozzle can be recovered, such that the ejection of the liquid droplet can be performed again. Further, in the case in which the determination result is to the extent that the exchange of the ejection head is required, the ejection head itself can be exchanged, such that the ejection of the liquid droplet can be performed again.

Further, in the nozzle determined as having an abnormality that can be recovered, the nozzle is recovered by the recovery operation without exchanging the ejection head. Thus it is possible to simplify the exchange process of the ejection head 20 and it is possible to save the liquid material within the ejection head 20, for example, as compared with promptly exchanging the ejection head 20 when abnormality of the nozzle is determined. Further, for example, a high-priced industrial liquid material does not become useless, and thus it is possible to reduce a production cost.

Further, after the ejection head 20 ejects the liquid droplet a predetermined number of times, the peripheral portion of the nozzle is imaged. Thus, it is possible to image the state of the nozzle changed by corrosion of the thin film (eutectic plating). Further, based on the image imaged in such a manner, abnormality or normality of the nozzle is determined. Thus it is possible to discover the abnormal nozzle generated while the liquid droplet is ejected a predetermined number of times.

Further, in the case in which the peripheral portion of the nozzle is imaged at the magnified scale, it is possible to image the shape of the nozzle in detail. Further, in case of the reduced scale, it is possible to image a plurality of nozzles simultaneously.

The captured image may be a color image or a monochrome image. In case of the color image, it is possible to confirm the shape of the nozzle or the corrosion state of the thin film (eutectic plating) of the peripheral portion, and the residual of the liquid material attached to the vicinity of the nozzle. Thus, it is possible to acquire imaging information in detail. Further, in case of the monochrome image, it is possible to confirm the shape of the nozzle in an image of white and black mode. Thus it is possible to image imaging information more simple than the color image.

Second Example of Ejection Performance Determination of Nozzle

Next, a second example of an ejection performance determination of the nozzle will be described with reference to FIGS. 6, 12, 13 and 14.

Figure 12:
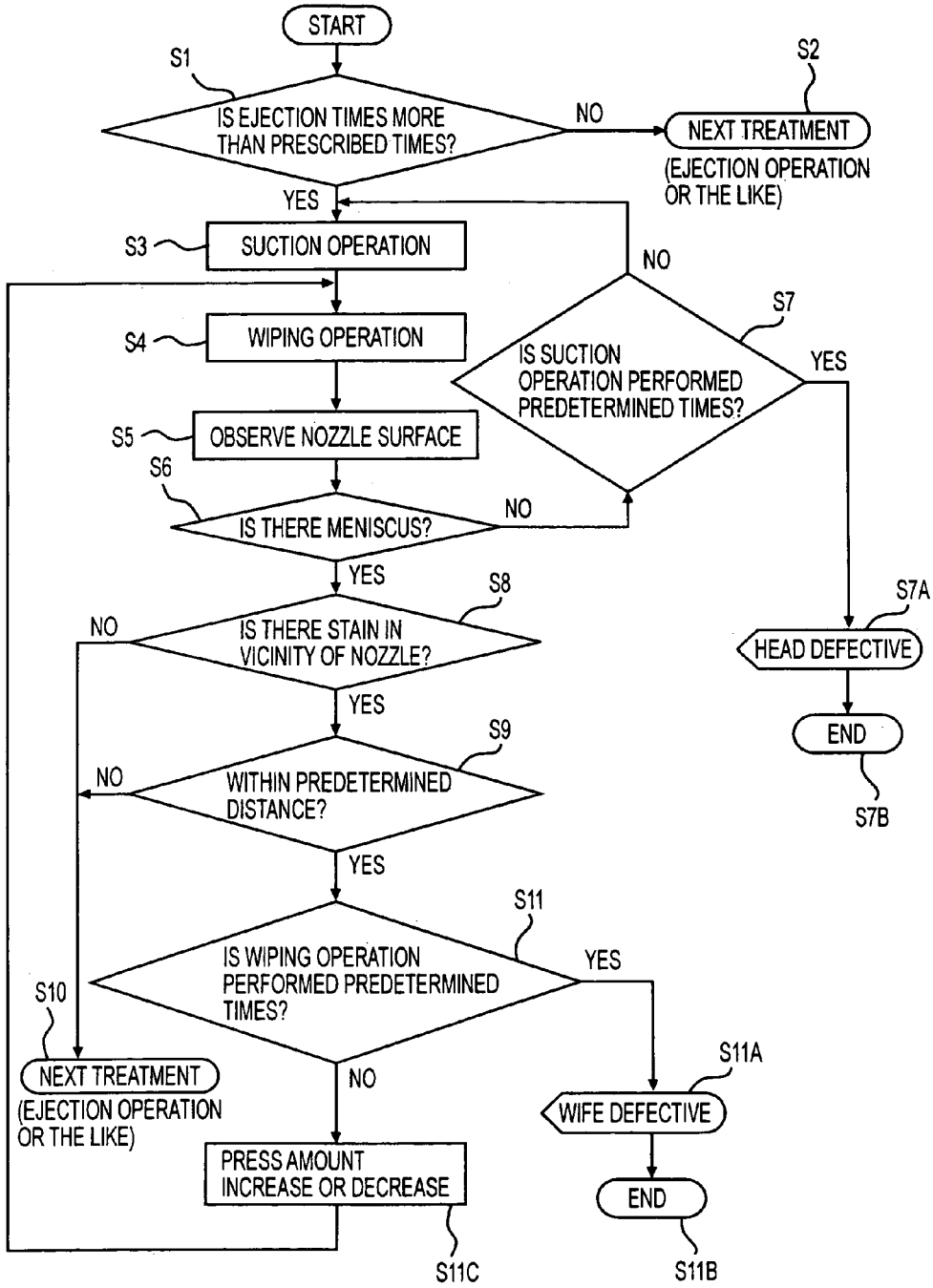
FIG. 12 is a flowchart showing an example of an ejection performance determination processing of a nozzle.

FIG. 12 is a flowchart showing an example of the ejection performance determination of the nozzle. In this flowchart, the overall flow is generally managed by the central control unit 150 of FIG. 6.

First, as shown in FIG. 12, it is determined whether the number of ejection times of the liquid droplet ejected from the ejection head 20 is more or less than the predetermined number of times (step 1).

Here, the number of ejection times of the liquid droplet is the number of the liquid droplets to be ejected from the ejection head 20 which is counted by the central control unit 150, as described in the "liquid droplet ejection operation of ejection Head". Further, the predetermined number of times is the number of times previously set in the central control unit 150. Further, the number of ejection times described herein represents an average value for each nozzle.

Then, if the number of ejection times is less than the predetermined number of times (in case of NO), it is determined that it is not necessary to observe the nozzle. Then the process progresses to the next step, such as the liquid droplet ejection operation (step 2). Further, if the number of ejection times is more than the predetermined number of times (in case of YES), it is determined that it is necessary to observe the nozzle. Then a series of observations of the nozzle described below is performed.

Next, in the nozzle forming surface 20P of the ejection head 20, the suction operation is performed (step 3). The suction operation is performed in the suction/wipe unit 23 shown in FIGS. 1 and 4.

Specified operation will be described with reference to FIG. 4. First, the cavity 81 is connected to the nozzle forming surface 20P of the ejection head 20. Next, in this state, the suction pump 82 sucks air in a space formed by the ejection head 20 and the cavity 81. By sucking the space, attachments of the nozzle surface of the ejection head 20 or a bubble in the flow passage is sucked, together with the liquid material. By performing such suction, for example, the ejection extraction or the defective nozzle is recovered.

Such a suction operation is performed by the central control unit 150 of FIG. 6 which issues a suck instruction to the suction unit control unit 153 and the suction unit control unit 153 which controls the driving of the suction unit 80*a*. Moreover, the number of execution times of such a suction operation is counted by and stored in the central control unit 150. Then it becomes information required to determine the defectiveness of the ejection head 20 as described below.

Further, the suction amount to be sucked by the suction pump 82 is previously set in the suction unit control unit 153.

Returning to FIG. 12 again, next, in the nozzle forming surface 20P of the ejection head 20, a wiping operation is performed (step 4). The wiping operation is performed in the suction/wipe unit 23 shown in FIGS. 1 and 4. Since the wiping operation is described above in detail, here, the details will be omitted.

Such a wiping operation is performed by the central control unit 150 of FIG. 6 which issues a wiping instruction to the wiping unit control unit 154 and the wiping unit control unit 154 which controls the driving of the wiping unit 80*b*. Moreover, the number of execution times of such a wiping operation is counted by and stored in the central control unit 150, and then it becomes information required to determine the quality of the wiper 83 as described below.

Next, the observation of the nozzle surface for imaging the nozzle forming surface 20P of the ejection head 20 is performed (step 5). The observation of the nozzle surface is performed in the camera unit 24. Since the observation operation of the nozzle surface is described above in detail, here, the details will be omitted.

Such a nozzle surface observation is made by the control of the imaging control unit 160 of FIG. 6. As a result, in the imaging unit 91, the image of the peripheral portion of the nozzle and in particular, in the present example, the image which can recognize the state of the meniscus in the nozzle is acquired, and the acquired image is transmitted to the determination unit 162.

Next, during imaging the nozzle forming surface 20P, the determination of the state of the meniscus in the nozzle is performed based on the image obtained by having imaged the inside of the nozzle at the magnified scale (step 6). Specifically, the determination whether the meniscus is favorably formed in the inside of the nozzle, i.e., the determination relating to presence/absence (quality) of the meniscus, is performed.

The presence/absence (quality) of the meniscus is determined according to brightness of the inside of the nozzle in which reflective light of illumination light to the meniscus is reflected. Further, the determination may be performed by a color of the liquid material of the meniscus. Both determination methods can be suitably selected when the captured image is the color image or when the captured image is the monochrome image. Further, both determination methods may be simultaneously used.

Such a determination of the state of the meniscus is performed by the determination unit 162 of FIG. 6, and the determination result is transmitted to the central control unit 150. Then, if the meniscus does not exist (in case of NO), it is determined that the nozzle is abnormal, and then the process progresses to the next step 7. Further, in the case in which the meniscus exists (in case of YES), it is determined that the nozzle is favorable, and the process progresses to the next step 8.

Figure 13A:
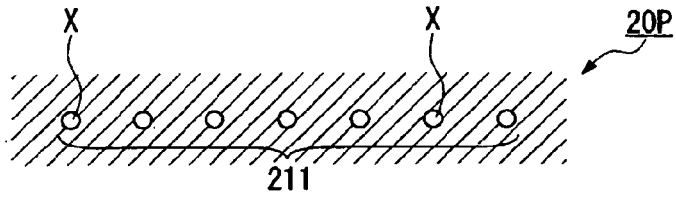
FIG. 13A is a schematic showing an example of a captured image in which a meniscus exist or which is determined as normal.
Figure 13B:
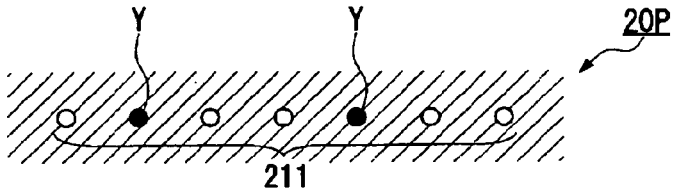
FIG. 13B is a schematic showing a captured image in which a meniscus does not exist or which is determined as defective.

Here, with reference to FIGS. 13A and 13B, an example of a determination result of presence/absence (quality) of the meniscus of the inside of the nozzle in the nozzle forming surface 20P will be described. FIGS. 13A and 13B show an image imaged by the imaging unit 91. Further, FIG. 13A is a schematic showing the state of the nozzle in which the meniscus exists or it is determined that the nozzle is normal. FIG. 13B is a schematic showing the state of the nozzle in which the meniscus does not exist or it is determined that the nozzle is abnormal.

As shown in FIG. 13A, in the nozzle in which the meniscus exists or it is determined that the nozzle is normal, the reflective portion X of illumination light is present inside the nozzle. To the contrary, as shown in FIG. 13B, in the nozzle in which the meniscus does not exist or it is determined that the nozzle is abnormal, a black portion Y is present inside the nozzle. The black portion Y is a portion in which illumination light is not reflected, and it means that the liquid material constituting the meniscus is not formed.

Returning to FIG. 12 again, in the step 7, by comparing the number of execution times of the suction operation stored in the central control unit 150 with the predetermined number of times previously set, it is determined whether the number of execution times of the suction operation is more or less than the predetermined number of times.

Then, if the number of execution times is more than the predetermined number of times (in case of YES), it is determined that the ejection head 20 is defective (step 7A). Then the central control unit 150 instructs the display unit (head abnormality display unit 165), such as a display device to display a message for promoting the exchange of the ejection head 20, such that the flow ends (step 7B). Further, the number of execution times is less than the predetermined number of times (in case of NO), the process returns to the step 3 to perform the suction operation, and then the process is performed based on the respective steps.

In the step 8, during imaging the nozzle forming surface 20P, the determination of presence/absence of contaminants in the vicinity of the nozzle is performed based on the image obtained by having imaged the vicinity of the nozzle.

The presence/absence of the contaminants is determined by a difference in brightness in which reflective light of illumination light to the contaminants is reflected. Further, the determination may be performed by a difference in color in the nozzle forming surface 20P. Both determination methods can be suitably selected when the captured image is the color image or when the captured image is the monochrome image. Further, both methods can be simultaneously used.

The determination of the presence/absence of the contaminants is also performed by the determination unit 162 of FIG. 6. Then, if the contaminants exist in the vicinity of the nozzle (in case of YES), the process progresses to the next step 9. Further, if the contaminants do not exist in the vicinity of the nozzle (in case of NO), the determination result is sent to the central control unit 150 of FIG. 6, and the process progresses to the next step 10.

In the step 9, the determination whether or not the contaminants attached to the vicinity of the nozzle are within the predetermined distance from the nozzle is performed. The determination is performed in the control device CONT. Then, if the contaminants are within the predetermined distance (in case of YES), the determination result of the purport is replied to the central control unit 150 of FIG. 6, and the process progresses to the next step 11. Further, if the contaminants are not within the predetermined distance (in case of NO), the determination result of the purport is replied to the central control unit 150 of FIG. 6, and the process progresses to the next step 10.

Figure 14A:
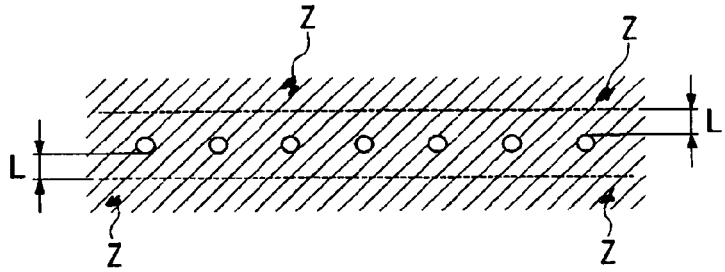
FIG. 14A is a schematic showing an example of a captured image which is determined that contaminants are not within a predetermined distance from a nozzle.
Figure 14B:
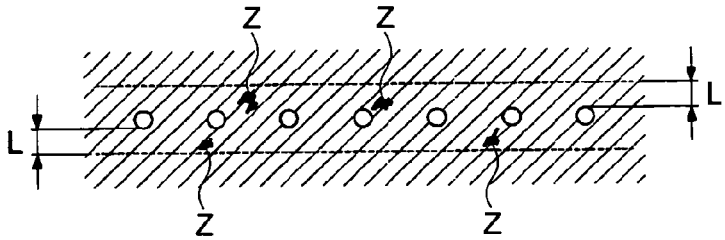
FIG. 14B is a schematic showing an example of a captured image which is determined that contaminants are within a predetermined distance from a nozzle.

Here, with reference to FIGS. 14A and 14B, an example of a determination result regarding whether or not the contaminants of the nozzle forming surface 20P are within the predetermined distance from the nozzle 211 will be described. FIGS. 14A and 14B show an image imaged by the imaging unit 91. Further, FIG. 14A is a schematic when it is determined that the contaminants are not within the predetermined distance from the nozzle 211. FIG. 14B is a schematic when it is determined that the contaminants are within the predetermined distance.

As shown in FIG. 14A, in the case in which it is determined that the contaminants are not within the predetermined distance from the nozzle 211, the contaminant Z is present outside the range of the length L from the nozzle 211. As shown in FIG. 14B, in the case in which it is determined that the contaminants are within the predetermined distance, the contaminant Z is present within the range of the length L from the nozzle 211.

In such a manner, in the case in which the contaminant Z exists in a position farther than the nozzle 211, specifically, at a distance longer than the length L, the contaminant Z does not influence the ejection of the liquid droplet. If the contaminant Z exists closely to the nozzle 211, specifically, at a distance shorter than the length L, the contaminant Z causes the curved flight of the liquid droplet or the lowering of the land precision.

Returning to FIG. 12, in the step 10, the processing, such as the liquid droplet ejection is performed. In such a step 10, since the state of the meniscus of the nozzle is favorable through the above-mentioned observation of the nozzle surface, as described with reference to FIGS. 7A-8B, it is possible to eject a favorable liquid droplet according to the voltage waveform V(t). Further, since it is determined that the contaminant does not exist within the predetermined distance from the nozzle, it is possible to eject the liquid droplet, without causing the curved flight and the lowering of the land precision due to the contaminant.

In the step 11, by comparing the number of execution times of the wiping operation stored in the central control unit 150 with the predetermined number of times previously set, it is determined whether the number of execution times of the wiping operation is more or less than the predetermined number of times.

Then, in the case in which the number of execution times is more than the predetermined number of times (in case of YES), it is determined that the wiper 83 is abnormal (step 11A). Then the central control unit 150 instructs the display unit (head abnormality display unit 165), such as a display device, to display a message to promote the exchange of the ejection head 20, such that the flow ends (step 11B). Further, in the case in which the number of execution times is less than the predetermined number of times (in case of NO), the pressing amount of the wiper 83 to the nozzle forming surface 20P increases or decreases, or the adjustment of the drive unit 84 is performed (step 11C). In addition, returning to the step 4, the wiping operation is performed. Then the process is performed based on the respective steps.

As described above, in the present example, unlike a technique in which abnormality of a liquid material, a bubble-like residual of the liquid material or a stain of the liquid material attached to a nozzle unit is observed as in the related art, it is possible to acquire an image which can recognize the state of the meniscus in the nozzle since the inside of the nozzle is imaged.

Based on the image of the inside of the imaged nozzle, it becomes possible to determine the quality of the nozzle. Further, based on the determination result, the defective nozzle is enhanced, and it is possible to make all the nozzles in the ejection head 20 have a favorable state so that normal ejection is possible. Therefore, it becomes possible to eject the liquid droplet Q' according to the voltage waveform V(t) supplied to the piezoelectric element 240. Further, it is possible to achieve high precision of the position at which the liquid droplet Q' is ejected on the substrate P (high precision of the land position) and variation reduction of the liquid droplet amount.

Based on the determination result of the normal nozzle and the defective nozzle, the defective nozzle may be enhanced, and the normal nozzle may be used as it is. Thus, as compared with the case of simply sucking the liquid materials equally in the normal nozzle and the defective nozzle, there is no need to suck the liquid material in the normal nozzle uselessly. Specifically, since it is possible to save the liquid material, a high-priced industrial liquid material does not become useless. Thus it is possible to reduce the production cost.

Instead of simply imaging the inside of the nozzle, the state of the meniscus of the liquid material filled inside the nozzle is imaged. Thus, it becomes possible to determine the quality of the meniscus required to normally eject the liquid droplets and it is possible to enhance the defective meniscus based on the determination result. As a result, it is possible to make the meniscuses in all the nozzles have a favorable state so that a normal ejection is possible.

Further, since the above-mentioned observation of the nozzle is performed after ejecting the liquid droplet the predetermined number of times, it is possible to see the defective nozzle while the liquid droplet is ejected the predetermined number of times.

Moreover, the present invention is not limited to the method in which the nozzle observation is performed in every predetermined number of times. But, alternatively, a method in which the nozzle observation is performed after the predetermined time lapses may be adopted.

Since the residual of the liquid material attached to the nozzle forming surface 20P is removed by means of wiping, it is possible to maintain the nozzle forming surface 20P in a clean state. Therefore, since the residual of the liquid material causing the curved flight is removed, it is possible to enhance the landing precision.

Since the liquid material is sucked from the nozzle forming surface 20P, it is possible to fill the defective nozzle with the liquid material. Further it is possible to form the meniscus in the defective nozzle. Therefore, it is possible to enhance the defective nozzle so as to eject the liquid droplet normally.

As a result of determining whether or not the contaminants are within the predetermine distance from the nozzle, if it is determined that the contaminants are within the predetermined distance, the contaminants on the nozzle forming surface 20P are removed. Thus, it is possible to suppress the curved flight or the lowering of the land precision due to the contaminants remaining on the nozzle forming surface 20P. Further, if it is determined that the contaminants are outside the predetermined distance, the contaminants do not influence the curved flight or the land precision at the time of ejecting the liquid droplets. Therefore, the contaminants may remain. Thus there is no need for a step of removing the contaminants. As a result, it is possible to design a simple process.

There is no need to wipe the nozzle forming surface 20P uselessly, and thus it is possible to perform the ejection optimally.

Based on the determination result of the normal nozzle and the defective nozzle, the defective nozzle may be enhanced, and the normal nozzle may be used as it is. Thus, as compared with the case of simply sucking the liquid materials equally in the normal nozzle and the defective nozzle, there is no need to suck the liquid material in the normal nozzle uselessly. That is, since it is possible to save the liquid material, a high-priced industrial liquid material does not become useless. Thus it is possible to reduce the production costs.

Moreover, in the above-mentioned example, the suction/wipe unit 23 sucks all the plurality of nozzles, but as a modified example of the suction/wipe unit 23, a construction in which only one nozzle among the plurality of nozzles formed in the ejection head 20 is selectively sucked, may be adopted.

According to this construction, the liquid material is selectively sucked from the defective nozzle. Thus it is possible to fill the defective nozzle with the liquid material to form the meniscus. Further, the liquid material is not sucked from the nozzles which are determined as normal, among the plurality of nozzles. Thus there is no case in which the liquid material is sucked uselessly. Therefore, for example, in the ejection head filled with the high-priced liquid material, there is no need to suck the liquid material uselessly. Thus it is possible to save the liquid material.

Further, as another modified example of the suction/wipe unit 23, a construction in which the plurality of nozzles are divided into the nozzle regions for every predetermined number of nozzles and each nozzle region is sucked may be adopted.

If doing so, the liquid material is sucked from only the nozzle region having the defective nozzle. Then it is possible to fill the defective nozzle with the liquid material to form the meniscus. Here, since the liquid material is not sucked from the nozzle region having the nozzle, which is determined as normal, among the plurality of nozzles, the liquid material is not sucked uselessly. Therefore, for example, in the ejection head filled with the high-priced liquid material, there is no need to suck the liquid material uselessly. Thus it is possible to save the liquid material. Further, generally, in the case in which a nozzle pitch is minute, a minute suction unit to suck the liquid material from only one nozzle is needed. Thus the suction of the liquid material is difficult. However, in an exemplary aspect of the present invention, in the case in which the liquid material is sucked from the nozzle region, it is possible to enlarge the size of the suction unit. Thus it is possible to perform easily the suction of the liquid material. Further, as compared with the case of sucking the liquid material from all the nozzles, the liquid material is sucked from only the nozzle region having the defective nozzle, and thus it is possible to save the liquid material.

Display Device

Next, a display device manufactured using the liquid droplet ejection device and the liquid droplet ejection method will be described.

Plasma Display Device

Figure 15:
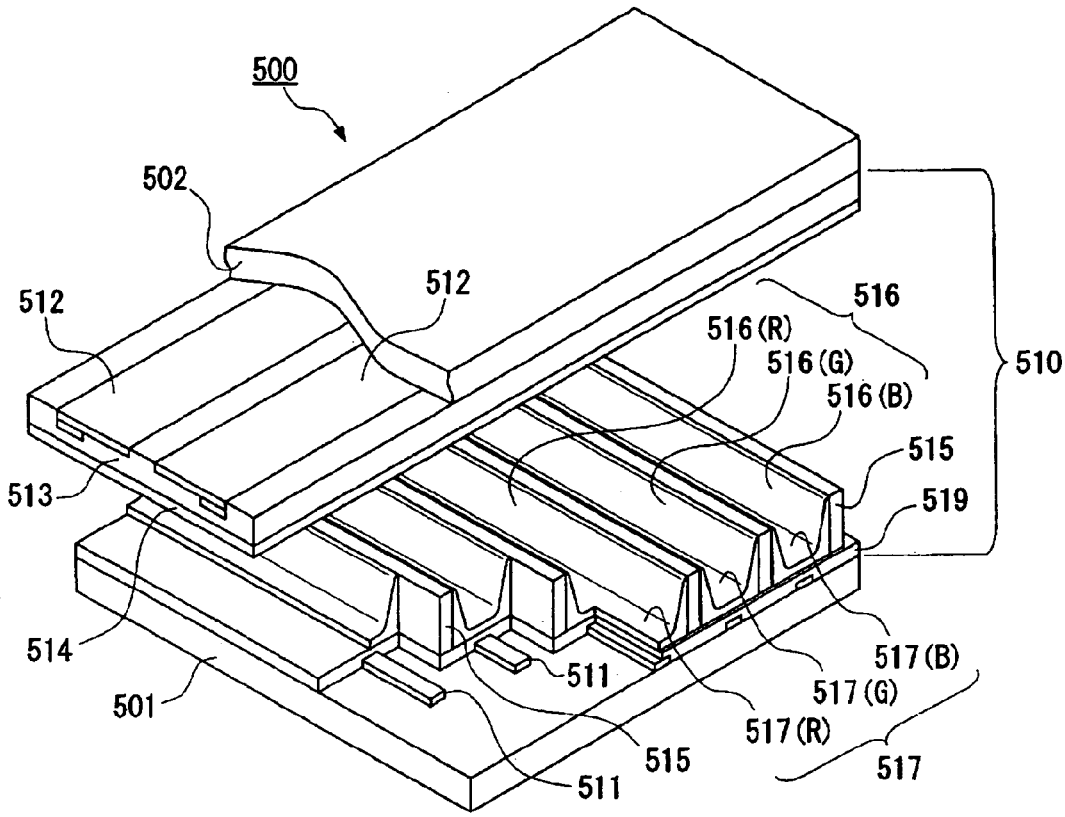
FIG. 15 is a schematic showing a construction of an example of a plasma display device.

FIG. 15 is a schematic of a plasma display device 500 according to the present exemplary embodiment.

The plasma display device 500 includes substrates 501 and 502 which are arranged opposite to each other, and a discharge display unit 510 formed therebetween.

The discharge display unit 510 has a plurality of discharge cells 516. Among the plurality of discharge cells 516, a red discharge cell 516(R), three discharge cells 516 of a green discharge cell 516(G) and a blue discharge cell 516(B) are arranged to constitute one pixel.

On an upper surface of the substrate 501, address electrodes 511 are formed in a stripe shape at a predetermined interval, and a dielectric layer 519 is formed to cover the address electrodes 511 and the upper surface of the substrate 501.

On the dielectric layer 519, partition walls 515 are formed to be located between the address electrodes 511 and 511 along the respective address electrodes 511. The partition walls 515 include partition walls adjacent to right and left sides of the address electrodes 511 in a widthwise direction and partition walls extending in a direction orthogonal to the address electrodes 511. In addition, the discharge cells 516 are formed to correspond to a rectangular region partitioned by the partition walls 515.

Further, inside rectangular regions divided by the partition walls 515, fluorescent substances 517 are arranged. The fluorescent substances 517 emit fluorescent light components of red, green and blue. In a bottom portion of the red discharge cell 516(R), a red fluorescent substance 517(R) is arranged, and in a bottom portion of the green discharge cell 516(G), a green fluorescent substance 517(G) is arranged. Further, in a bottom portion of the blue discharge cell 516(B), a blue fluorescent substance 517(B) is arranged.

In the substrate 502, a plurality of display electrodes 512 are formed in a stripe shape at a predetermined interval in a direction orthogonal to the above-mentioned address electrodes 511. In addition, a dielectric layer 513 to cover the display electrodes, and a protective film 514 made of MgO are formed.

The substrate 501 and the substrate 502 are joined such that the address electrodes 511 . . . and the display electrodes 512 . . . face orthogonally to each other.

The address electrodes 511 and the display electrodes 512 are connected to an alternating current (AC) power source which is not shown. By supplying electricity to the respective electrodes, the fluorescent substance 517 in the discharge display unit 510 excites and emits, such that a color display is implemented.

In such a plasma display device 500, the address electrodes 511 and the display electrodes 512 are formed using the liquid droplet ejection device IJ shown in FIG. 1, based on the above-mentioned liquid droplet ejection method and the above-mentioned nozzle abnormality determination method. Such address electrodes 511 and display electrodes 512 are formed by filling the ejection head 20 of the liquid droplet ejection device IJ with a dispersing solution in which metallic fine particles are dispersed in a solvent, such as xylene and by performing the liquid droplet ejection operation in a predetermined pattern. Further, removing the solvent and sintering the metallic fine particles may be suitably used.

Liquid Crystal Display Device

Figure 16A:
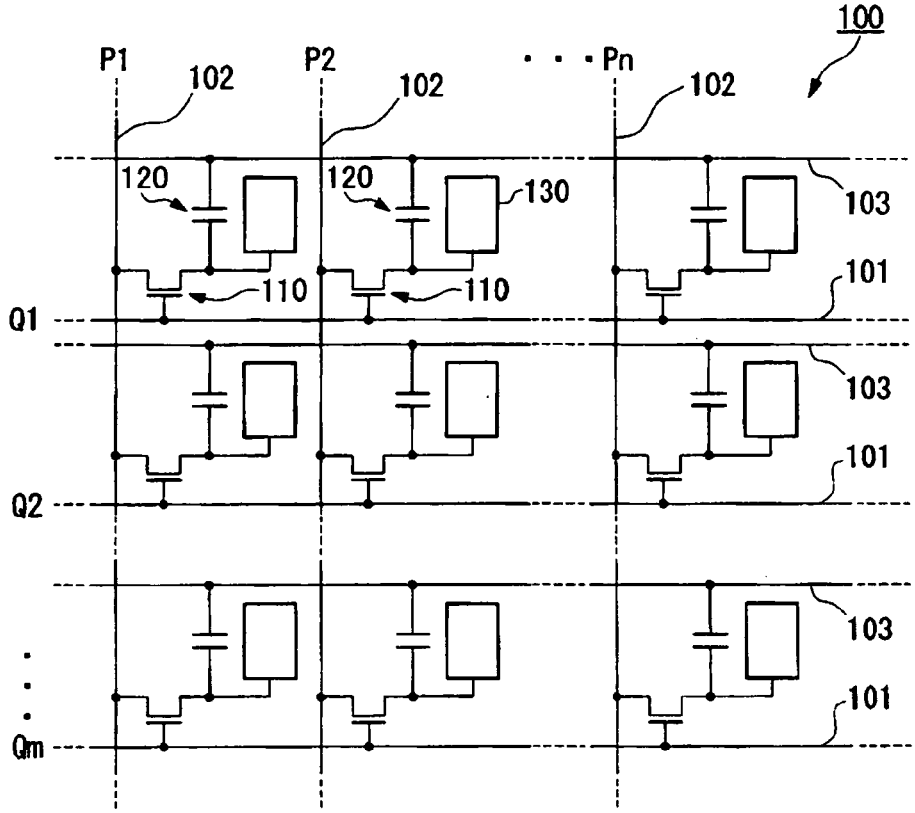
FIG. 16A is a circuit schematic of an example of various elements and wiring lines which constitute an image display region of a liquid crystal display device.
Figure 16B:
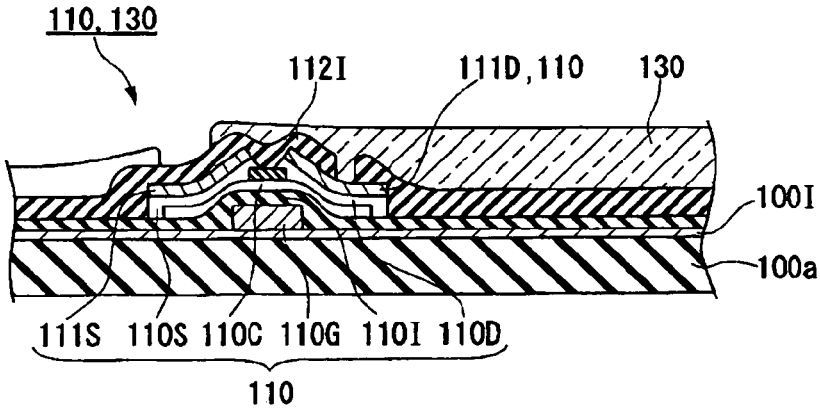
FIG. 16B is an expanded cross-sectional schematic of parts of the liquid crystal display device.

FIGS. 16A and 16B are schematics illustrating a liquid crystal display device. FIG. 16A is an equivalent circuit of various elements, such as switching elements or wiring lines constituting an image display region of the liquid crystal display device. FIG. 16B shows essential parts of the liquid crystal display device and is an expanded cross-sectional view of a structure of a switching element and a pixel electrode constituting one pixel.

As shown in FIG. 16A, the liquid crystal display device 100 includes scanning lines 101 and data lines 102 arranged in a matrix shape, pixel electrodes 130 and a plurality of pixel switching TFTs (hereinafter, "TFT) 110 to control the pixel electrodes 130. In the scanning lines 101, scanning signals Q1, Q2 . . . , Qm are supplied in a pulse shape, and in the data lines 102, image signals P1, P2, . . . Pn are supplied. The scanning lines 101 and the data lines 102 are connected to the TFTs 110 as described below and the TFTs 110 are driven by the scanning signals Q1, Q2 . . . , Qm and the image signals P1, P2, . . . Pn. In addition, storage capacitors 120 to hold the image signals P1, P2 . . . , Pn having predetermined levels for a constant period are formed and capacitor lines 103 are connected to the storage capacitors 120.

Next, with reference to FIG. 16B, a structure of the TFT 110 will be described.

As shown in FIG. 16B, the TFT 110 is a so-called bottom gate type (inversed stagger type) TFT. Specifically, an insulating substrate 100*a* which is a base substrate of the liquid crystal display device 100, a base protective film 100I formed on a surface of the insulating film 100*a*, a gate electrode 110G, a gate insulating film 110I, a channel region 110C, and an insulating film 112I to protect the channel are sequentially deposited. In both sides of the insulating film 112I, a source region 110S and a drain region 110D that are highly doped N-type amorphous silicon film are formed. On the surfaces thereof, a source electrode 111S and a drain electrode 111D are respectively formed.

On surfaces thereof, the insulating film 112I and the pixel electrode 130 made of a transparent electrode, such as ITO are formed, and the pixel electrode 130 is electrically connected to the drain electrode 111D via a contact hole of the insulating film 112I.

Here, the gate electrode 110G is a part of the scanning line 101, and the source electrode 111S is a part of the data line 102. In addition, the gate electrode 110G and the scanning line 101 are formed with the method of forming the pattern described above.

In such a liquid crystal display device 100, a current is supplied from the scanning line 101 to the gate electrode 110G according to the scanning signals Q1, Q2, . . . Qm, an electric field is generated in the vicinity of the gate electrode 110G, and by the reaction of the electric field, the channel region 110C is in a conduction state. In addition, in the conduction state, a current is supplied from the data line 102 to the source electrode 111S according to the image signals P1, P2, . . . , Pn, and is electrically connected to the pixel electrode 130, such that a voltage is supplied between the pixel electrode 130 and a counter electrode. Specifically, by controlling the scanning signals Q1, Q2, . . . , Qm and the image signals P1, P2, . . . , Pn, it is possible to desirably drive the liquid crystal display device.

In such a liquid crystal display device, the gate electrodes 110G and the scanning lines 101 are formed using the liquid droplet ejection device IJ shown in FIG. 1, based on the above-mentioned liquid droplet ejection method and the above-mentioned nozzle abnormality determination method. Such gate electrodes 110G and scanning lines 101 are formed by filling the ejection head 20 of the liquid droplet ejection device IJ with a dispersing solution in which metallic fine particles are dispersed in a solvent, such as xylene and by performing the liquid droplet ejection operation in a predetermined pattern. Further, removing the solvent and sintering the metallic fine particles may be suitably used.

Field Emission Display

Figure 17A:
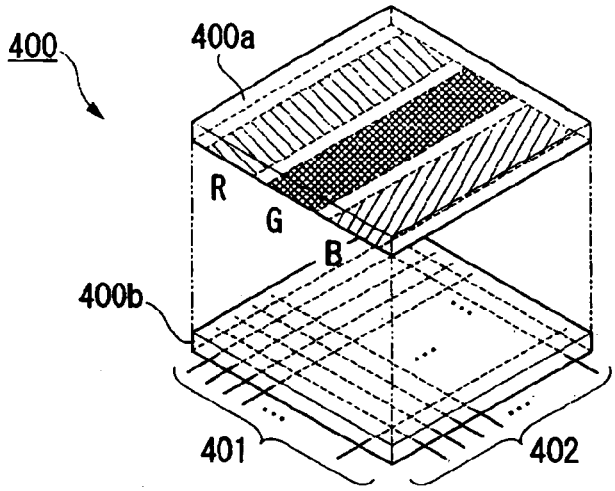
FIG. 17A is a schematic showing an arrangement of a cathode substrate and an anode substrate of a field emission display.
Figure 17B:
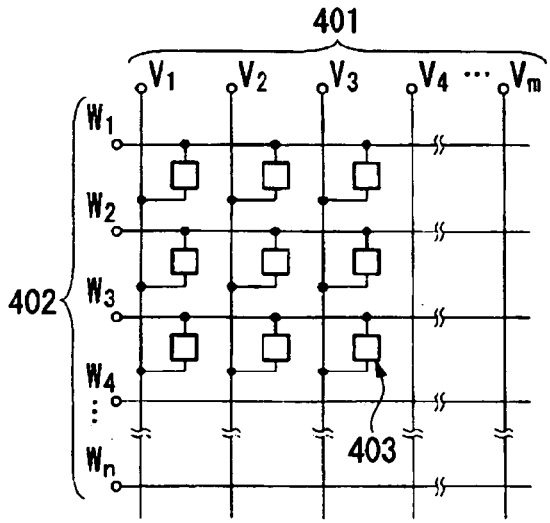
FIG. 17B is a drive circuit schematic which is provided in the cathode substrate of the field emission display.
Figure 17C:
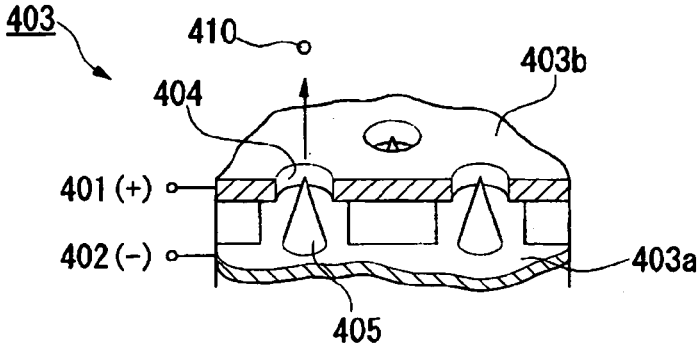
FIG. 17C is a schematic showing essential parts of the cathode substrate of the field emission display.

FIGS. 17A-17C are schematics illustrating a field emission display (hereinafter, "FED"). FIG. 17A is a schematic showing an arrangement of a cathode substrate and an anode substrate constituting the FED, FIG. 17B is a schematic of a drive circuit provided in the cathode substrate of the FED. FIG. 17C is a schematic showing essential parts of the cathode substrate.

As shown in FIG. 17A, the FED 400 is constructed such that the cathode substrate 400*a* and the anode substrate 400*b* are arranged oppositely to each other. As shown in FIG. 17B, the cathode substrate 400*a* includes gate lines 401, emitter lines 402 and field emission elements 403 connected to the gate lines 401 and the emitter lines 402. Specifically, the cathode substrate 400*a* is constructed in a so-called simple matrix drive circuit. In the gate lines 401, gate signals V1, V2, . . . , Vm are supplied, and in the emitter lines 402, emitter signals W1, W2, . . . , Wn are supplied. Further, the anode substrate 400*b* includes a fluorescent substance made of RGB, and the fluorescent substance has a nature of emitting light when an electron contacts.

As shown in FIG. 17C, the field emission element 403 includes an emitter electrode 403*a* connected to the emitter line 402 and a gate electrode 403*b* connected to the gate line 401. In addition, the emitter electrode 403*a* includes a protrusion which is referred to as an emitter tip 405 and of which the diameter becomes small from the side of the emitter electrode 403*a* toward the gate electrode 403*b*. Further, at a position corresponding to the emitter tip 405, a hole 404 is formed in the gate electrode 403*b*. The front end of the emitter tip 405 is arranged in the hole 404.

In such a FED 400, by controlling the gate signals V1, V2, . . . Vm of the gate lines 401 and the emitter signals W1, W2, . . . Wn of the emitter lines 402, a voltage is supplied between the emitter electrode 403*a* and the gate electrode 403*b*, and by the reaction of electrolysis, an electron 410 moves from the emitter tip 405 toward the hole 404, such that the electron 410 is emitted from the front end of the emitter tip 405. Here, since light emits by contacting the electron 410 and the fluorescent substance of the anode substrate 400*b*, it becomes possible to drive the FED 400 desirably.

Further, in such a FED 400, the emitter electrodes 403*a* and the emitter lines 402 are formed using the liquid droplet ejection device IJ shown in FIG. 1, based on the above-mentioned liquid droplet ejection method and the above-mentioned nozzle abnormality determination method.

Such emitter electrodes 403*a* and emitter lines 402 are formed by filling the ejection head 20 of the liquid droplet ejection device IJ with a dispersing solution in which metallic fine particles are dispersed in a solvent, such as xylene and by performing the liquid droplet ejection operation in a predetermined pattern. Further, removing the solvent and sintering the metallic fine particles may be suitably used.

Moreover, the method of forming the pattern according to the present exemplary embodiment is not limited to the emitter electrodes 403*a* and the emitter lines 402, but it may also be applied to a method of forming other wiring lines, such as the gate electrodes 403*b* and the gate lines 401.

Organic Electroluminescent Display Device

Figure 18:
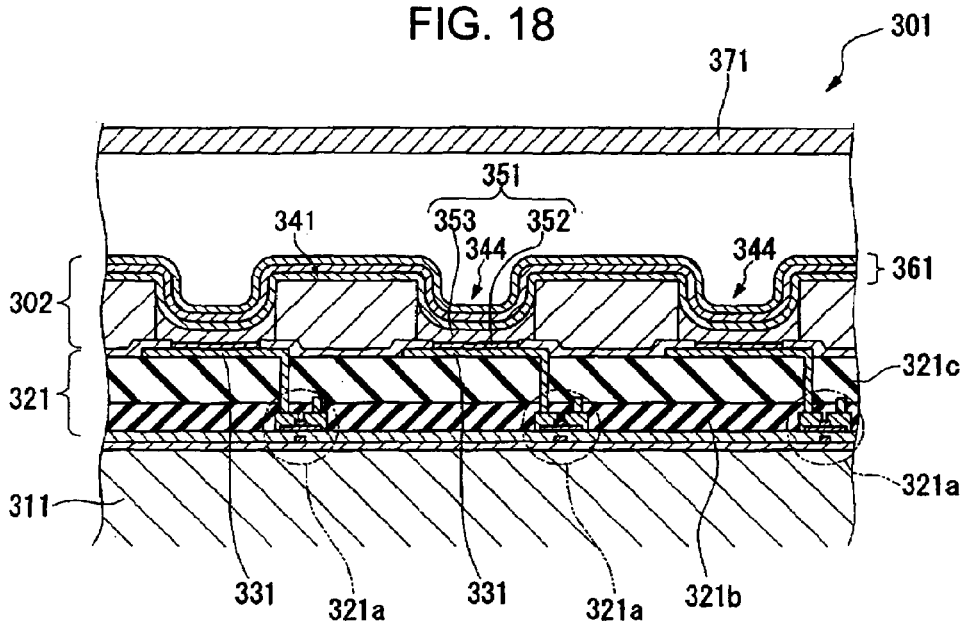
FIG. 18 is a schematic showing an example of an organic electroluminescent display device.

FIG. 18 is a schematic illustrating an organic electroluminescent display device (hereinafter, "organic EL Device").

As shown in FIG. 18, the organic EL device 301 is constructed such that wiring lines of a flexible substrate (not shown) and a driving IC (not shown) are connected to an organic EL element 302 which includes a substrate 311, a circuit element portion 321, a pixel electrode 331, a bank portion 341, a light emitting element 351, a cathode 361 (counter electrode) and a sealing substrate 371. The circuit element portion 321 is formed on the substrate 311 and a plurality of pixel electrodes 331 are arranged on the circuit element portion 321. Then, between the respective pixel electrodes 331, the bank portions 341 are formed in a lattice shape, and in concave openings 344 defined by the bank portions 341, the light emitting elements 351 are respectively formed. The cathode 361 is formed on an upper entire surface of the bank portions 341 and the light emitting elements 351, and on the cathode 361, the sealing substrate 371 is deposited.

The circuit element portion 32 includes a bottom gate type TFT 321*a*, a first interlayer insulating film 321*b* and the second interlayer insulating film 321*c*. Since the main construction of the TFT 321*a* is the same as that of the liquid crystal display device, the description thereon will be omitted. Further, the first interlayer insulating film 321*b* and the second interlayer insulating film 321*c* are portions which are formed by the manufacturing method of the interlayer insulating film according to an exemplary aspect of the present invention. Specifically, the film thicknesses of the respective interlayer insulating films are made to change according to concave and convex portions of insulating film forming regions in which the respective interlayer insulating films are formed such that the surfaces of the respective interlayer insulating films are smoothed.

The light emitting elements 351 are portions to be formed by the liquid droplet ejection method, and further they are formed on upper portions of the smoothed first interlayer insulating film 321*b* and second interlayer insulating film 321*c*.

Such an organic EL device 301 is a so-called high molecular type organic EL device which includes the light emitting elements 351 formed using the liquid droplet ejection method.

The manufacturing process of the organic EL device 301 including the organic EL elements includes a bank portion forming step of forming the bank portions 341, a plasma treatment step to suitably form the light emitting elements 351, a light emitting element forming step of forming the light emitting elements 351, a counter electrode forming step of forming the cathode 361, and a sealing step of depositing the sealing substrate 371 on the cathode 361 to seal the organic EL element.

In the light emitting element forming step, the respective light emitting elements 351 are constructed by forming a hole injecting layer 352 and a light emitting layer 353 on the concave opening 344, that is, the pixel electrode 331. Thus, this step includes a hole injecting layer forming step and a light emitting layer forming step. Then, the hole injecting layer forming step includes a first ejection step of ejecting a first composition (liquid material) onto the pixel electrode 331 to form the hole injecting layer 352 and a first dry step of drying the ejected first composition to form the hole injecting layer 352. Further, the light emitting layer forming step includes a second ejection step of ejecting a second composition (liquid material) onto the hole injecting layer 352 to form the light emitting layer 353 and a second dry step of drying the ejected second composition to form the light emitting layer 353.

In such an organic EL device, the hole injecting layer forming step and the light emitting layer forming step are formed using the liquid droplet ejection device IJ shown in FIG. 1, based on the above-mentioned liquid droplet ejection method and nozzle abnormality determination method.

Moreover, the organic EL device is not limited to the high molecular type, but it may be a low molecular type.

As described above, various display devices shown in FIGS. 15 to 18 are manufactured using the above-mentioned liquid droplet ejection device and liquid droplet ejection method. Thus it becomes possible to land a predetermined liquid material precisely at a predetermined position to form a pattern such as wiring lines or pixels. Further, it is possible to design the manufacturing process more simple than the related art photolithography technique, and it is possible to manufacture a low-priced display device. In addition, various display devices are manufactured using the liquid droplet ejection device which includes the above-mentioned camera unit 24 (imaging unit). Thus it is possible to attain high precision of the liquid droplet ejection and the variation reduction of the liquid droplet amount. Further, it is possible to reduce the production cost without making the liquid material useless.

Moreover, as a device to which the manufacturing method of an exemplary aspect of the present invention is applied, other devices including a wiring pattern may be included. For example, exemplary aspects of the present invention may be applied to the manufacture of the wiring pattern which is formed in the electrophoresis device.

Electronic Apparatus

Next, an example of an electronic apparatus including a display device according to the above-mentioned exemplary embodiment will be described.

Figure 19:
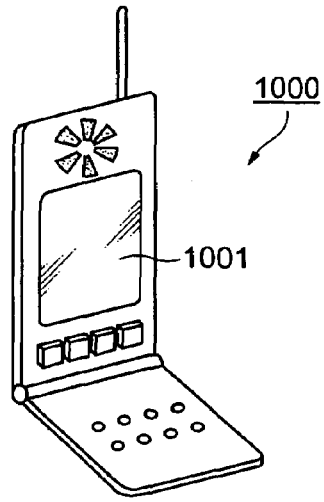
FIG. 19 is a schematic showing an example of an electronic apparatus.

FIG. 19 is a schematic of a cellular phone as an example of the electronic apparatus. In FIG. 19, the reference numeral 1000 denotes a cellular phone main body, and multilayer wiring board manufactured with the manufacturing method of the above-mentioned exemplary embodiment is used. Further, in FIG. 19, a liquid crystal display unit 1001 which includes the above-mentioned liquid crystal display device is shown.

The electronic apparatus shown in FIG. 19 includes the liquid crystal display device manufactured using the liquid droplet ejection of the above-mentioned exemplary embodiment, based on the liquid droplet ejection method and the nozzle abnormality forming method. Thus, as compared with the related art, it is possible to precisely manufacture the apparatus with the simple manufacturing process at low cost.

Moreover, the electronic apparatus of the present exemplary embodiment includes the liquid crystal display device. But electronic apparatus of various exemplary embodiments of the present invention may include electro-optical devices such as a plasma display device, a field emission display, an organic electroluminescent display device.

Further, exemplary aspects of the present invention are not limited to the cellular phone. Alternatively, exemplary aspects of the present invention may be applied to a wrist watch-type electronic apparatus or a portable information processing device, such as a word processor and a personal computer.

Moreover, the technical scope of the present invention is not limited to the above-mentioned exemplary embodiments, and it may be variously modified within a scope without departing from the spirit of the present invention. Specified materials, layer construction and the manufacturing method described in the above-mentioned exemplary embodiments are just examples and may be suitably modified.

For example, the manufacturing method according to an exemplary aspect of the present invention is not limited to a structure of multilayer printed wiring lines. But it may be applied to a manufacturing method of multilayer wiring lines of a large-sized display device or the like.

What is claimed is:

1. A method of determining abnormality of a nozzle of an ejection head including an ejection unit to eject liquid droplets, the method comprising:

imaging a peripheral portion of the nozzle;

comparing a shape of the nozzle with a shape of a normal nozzle;

determining the abnormality of the imaged nozzle; and determining the abnormality of the nozzle as a first abnormality in which the nozzle can be recovered by a recovery operation or a second abnormality in which the nozzle cannot be recovered by the recovery operation, wherein the second abnormality is based on whether or not a diameter of the nozzle is enlarged, whether or not an outline of the nozzle is defective, or whether or not a film used to coat a nozzle plate in which the nozzle is formed is present or removed in the vicinity of the nozzle.

2. The method of determining abnormality of a nozzle according to claim 1, further including imaging the peripheral portion of the nozzle after the ejection head ejects the liquid droplets a predetermined number of times.

3. The method of determining abnormality of a nozzle according to claim 1, further including imaging the peripheral portion of the nozzle at a magnified scale or at a reduced scale.

4. A liquid droplet ejection method in which an ejection head including an ejection unit to eject liquid droplets from a nozzle and a substrate arranged at a position opposing the ejection head, move relatively, and the liquid droplets are ejected onto the substrate according to a voltage waveform of a drive signal supplied to the ejection unit, the method comprising:

imaging a peripheral portion of the nozzle;

comparing the shape of the nozzle with the shape of a normal nozzle;

determining abnormality of the imaged nozzle; and determining the abnormality of the nozzle as a first abnormality in which the nozzle can be recovered by a recovery operation or a second abnormality in which the nozzle cannot be recovered by the recovery operation, wherein the second abnormality is based on whether or not a diameter of the nozzle is enlarged, whether or not an outline of the nozzle is defective, or whether or not a film used to coat a nozzle plate in which the nozzle is formed is present or removed in the vicinity of the nozzle.

5. A liquid droplet ejection method in which an ejection head including an ejection unit to eject liquid droplets from a nozzle and a substrate arranged at a position opposing the ejection head, move relatively, and the liquid droplets are ejected onto the substrate according to a voltage waveform of a drive signal supplied to the ejection unit, the method comprising:

imaging in the ejection head, the inside of the nozzle; and determining the abnormality of the nozzle as a first abnormality in which the nozzle can be recovered by a recovery operation or a second abnormality in which the nozzle cannot be recovered by the recovery operation, wherein the second abnormality is based on whether or not a diameter of the nozzle is enlarged, whether or not an outline of the nozzle is defective, or whether or not a film used to coat a nozzle plate in which the nozzle is formed is present or removed in the vicinity of the nozzle.

6. The liquid droplet ejection method according to claim 5, further including determining the quality of the nozzle based on an image acquired by imaging the inside of the nozzle.

7. The liquid droplet ejection method according to claim 5, further including imaging an inner surface of the nozzle and a contact state of a liquid material filled inside when the inside of the nozzle is imaged.

8. The liquid droplet ejection method according to claim 5, further including imaging the inside of the nozzle after the ejection head ejects the liquid droplets a predetermined number of times.

9. The liquid droplet ejection method according to claim 5, further including wiping a nozzle forming surface of the ejection head before the inside of the nozzle is imaged.

10. The liquid droplet ejection method according to claim 5, further including with regard to a determination result of the quality of the nozzle, sucking the liquid material up from the nozzle forming surface of the ejection head via the nozzle, if it is determined that the nozzle is defective.

11. The liquid droplet ejection method according to claim 10, the ejection head includes a plurality of nozzles, and with respect to determination results of the qualities of the plurality of nozzles, sucking the liquid material up from the nozzle forming surface via only the defective nozzle, if it is determined that at least one of the nozzles is defective.

12. The liquid droplet ejection method according to claim 10, the ejection head includes a plurality of nozzles and a plurality of nozzle regions in which the plurality of nozzles are divided into groups having a predetermined number of nozzles, and with respect to determination results of the qualities of the plurality of nozzles, sucking the liquid material up from the nozzle forming surface via the nozzle region having the defective nozzle, if it is determined that at least one of the nozzles is defective.

13. The liquid droplet ejection method according to claim 5, further including imaging liquid droplets or contaminants remaining on the nozzle forming surface of the ejection head, and it is determined whether or not the remaining liquid droplets or contaminants are within a predetermined distance from the nozzle.

14. A liquid droplet ejection device, comprising:

an ejection head including an ejection unit to eject liquid droplets from a nozzle; a substrate arranged at a position opposing the ejection head, the ejection head and the substrate moving relatively, and the liquid droplets are ejected onto the substrate according to a voltage waveform of a drive signal supplied to the ejection unit:

an imaging unit to image a peripheral portion of the nozzle in the ejection head;

a determination unit to compare the shape of the nozzle imaged by the imaging unit with the shape of a normal nozzle, and determining abnormality of the imaged nozzle wherein the abnormality is based on whether or not a diameter of the nozzle is enlarged, whether or not an outline of the nozzle is defective, or whether or not a film used to coat a nozzle plate in which the nozzle is formed is present or removed in the vicinity of the nozzle; and wherein the abnormality is a first abnormality in which the nozzle can be recovered a recovery operation or a second abnormality in which the nozzle cannot be recovered by the recovery operation.

15. The liquid droplet ejection device according to claim 14, further comprising:

a recovery unit to wipe a nozzle forming surface of the ejection head to recover the nozzle.

16. A display manufacturing device comprising the liquid droplet ejection device according to claim 14.

17. An electronic apparatus comprising the display manufacturing device according to claim 16.

18. A liquid droplet ejection device, comprising:

an ejection head provided with an ejection unit to eject liquid droplets from a nozzle;

substrate arranged at a position opposing the ejection head, the ejection head and the substrate moving relatively, and the liquid droplets are ejected onto the substrate according to a voltage waveform of a drive signal supplied to the ejection unit;

an imaging unit to image the inside of the nozzle in the ejection head; and a determination unit that determines an abnormality of the nozzle as a first abnormality in which the nozzle can be recovered by a recovery operation or as a second abnormality in which the nozzle cannot be recovered by the recovery operation, wherein the second abnormality is based on whether or not a diameter of the nozzle is enlarged, whether or not an outline of the nozzle is defective, or whether or not a film used to coat a nozzle plate in which the nozzle is formed is present or removed in the vicinity of the nozzle.

* * * * *